US006532856B2

(12) United States Patent
Kato et al.

(10) Patent No.: US 6,532,856 B2
(45) Date of Patent: Mar. 18, 2003

(54) PAPER CUTTING APPARATUS AND IMAGE FORMING APPARATUS

(75) Inventors: Norishige Kato, Tokyo (JP); Tetsuo Hirata, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/885,401

(22) Filed: Jun. 20, 2001

(65) Prior Publication Data

US 2001/0054342 A1 Dec. 27, 2001

(30) Foreign Application Priority Data

Jun. 26, 2000 (JP) ..... 2000-191060

(51) Int. Cl.[7] ..... B42C 9/00; B42C 11/02
(52) U.S. Cl. ..... 83/934; 83/373; 83/267
(58) Field of Search ..... 83/934, 267, 76.1–76.9

(56) References Cited

U.S. PATENT DOCUMENTS

| | | | | | |
|---|---|---|---|---|---|
| 3,570,344 | A | * | 3/1971 | Bryson et al. | 83/155 |
| 3,733,947 | A | * | 5/1973 | Bryson et al. | 414/19 |
| 4,030,394 | A | * | 6/1977 | Kistner et al. | 83/409 |
| 4,076,231 | A | * | 2/1978 | Kutzner et al. | 270/52.17 |
| 4,445,409 | A | * | 5/1984 | Mohr et al. | 83/157 |
| 4,505,173 | A | * | 3/1985 | Hartlage | 83/104 |
| 4,850,257 | A | * | 7/1989 | Mohr | 414/788 |
| 5,086,681 | A | * | 2/1992 | Ruetschle et al. | 83/253 |
| 5,146,824 | A | * | 9/1992 | Lajoie | 83/248 |
| 5,199,341 | A | * | 4/1993 | Jones | 83/100 |
| 5,214,992 | A | * | 6/1993 | Mohr | 83/157 |
| 5,295,775 | A | * | 3/1994 | Andjelic et al. | 412/16 |
| 5,377,569 | A | * | 1/1995 | Richards et al. | 83/397 |
| 5,465,213 | A | * | 11/1995 | Ross | 270/52.02 |
| 5,467,677 | A | * | 11/1995 | Kinson, Jr. | 271/198 |
| 5,694,823 | A | * | 12/1997 | Westra et al. | 83/147 |
| 5,715,737 | A | * | 2/1998 | Stauber et al. | 83/154 |
| 6,012,367 | A | * | 1/2000 | Westra et al. | 83/147 |
| 6,134,999 | A | * | 10/2000 | Herman | 83/35 |
| 6,152,002 | A | * | 11/2000 | Muller | 83/300 |
| 6,193,458 | B1 | * | 2/2001 | Marsh | 412/1 |

FOREIGN PATENT DOCUMENTS

| | | |
|---|---|---|
| JP | 6-072064 | 3/1994 |
| JP | 7-187479 | 7/1995 |
| JP | 8-192951 | 7/1996 |
| JP | 10-148983 | 6/1998 |
| JP | 10-167562 | 6/1998 |

* cited by examiner

*Primary Examiner*—Paul T. Sewell
*Assistant Examiner*—Nini F. Legesse
(74) *Attorney, Agent, or Firm*—Frishauf, Holtz, Goodman & Chick, P.C.

(57) ABSTRACT

The present invention concerns a paper sheet cutting apparatus which cuts the front end portion opposite to the fold, where both the leading edge and trailing edge get together by center folding, and an image forming apparatus equipped with the paper sheet cutting apparatus. The sheet cutting apparatus includes a conveying device for conveying a booklet; a stopping device for stopping the booklet at a predetermined position; a cutting device for cutting the front end portion of the booklet; and a controlling section to control each of the conveying device, the stopping device and the cutting device. The controlling section controls the stopping device so as to variably determine a stopping position of the booklet stopped by the stopping device, based on a number of sheets included in the booklet conveyed to the cutting device by the conveying device.

2 Claims, 20 Drawing Sheets

PAPER CUTTING APPARATUS AND IMAGE FORMING APPARATUS

BACKGROUND OF THE INVENTION

This invention relates to a paper sheet cutting apparatus which cuts the front end portion opposite to the fold, where both the leading edge and trailing edge get together by center folding, (hereinafter referred to simply as the front end) of a bundle of paper sheets for truing it up after it is subjected to center binding (what is called saddle stitch) processing and center folding processing for bookbinding, and an image forming apparatus equipped with the paper sheet cutting apparatus.

For a paper sheet after-processing apparatus which carries out center binding processing for a bundle of paper sheets which makes a set composed of a plurality of sheets, the publications of the unexamined patent application H6-72064, H7-187479, H8-192951, etc. have been hereofore known.

Further, a paper sheet after-processing apparatus which is capable of twofold processing has been proposed in the publications of the unexamined patent application H10-148983, H10-167562, etc.

There is a paper sheet cutting apparatus which cuts the front end of a bundle of paper sheets for truing it up after it is subjected to center binding processing and center folding processing for bookbinding. Further, in recent years, it has been provided a paper sheet after-processing apparatus, which is equipped with a paper sheet cutting apparatus which, for a bundle of paper sheets on which an image has been recorded by an image forming apparatus such as a copying machine, a printer, and a compound machine of these, cuts the front end of the sheets after the bundle of sheets is subjected to center binding processing and center folding processing by the paper sheet after-processing apparatus to make it bound like a weekly magazine.

With respect to a paper cutting apparatus which finishes a booklet through cutting the front end of the booklet, that has been subjected to center binding processing and center folding processing, by cutting means, there are problems as follows.

(1) While the driving source of the cutting means is driven, if a driving means other than the above-mentioned cutting means is operating, it sometimes occurs that the cutting position of the booklet is deviated by the vibration of the other driving means.

(2) When a booklet, which has been produced by the application of center binding processing and center folding processing to a plurality of paper sheets, is subjected to cutting processing, because the projection amount of the front end is different depending on the number of sheets per copy of the booklet, a constant measure of cutting produces the unevenness of the front end owing to an insufficient cutting amount, or waste of paper sheets owing to an excessive amount of cutting. Therefore, it is required a control for suppressing the cutting waste to minimum necessary amount for each of the numbers of sheets per copy of the booklet.

(3) When a booklet made of a small number of paper sheets is cut, a poor cutting such that a paper sheet is pulled in between the upper cutting blade and the lower cutting blade, the deviation of cutting position, etc. sometimes occur. In particular, in the case of thin paper sheets or paper sheets of weak stiffness, or the cutting blade of lowered edge quality, poor cutting occurs frequently. Thus, it is required such an automatic control as to inform the user, in the case where cutting processing is automatically cancelled for the reason that a thin paper sheets which are easy to produce poor cutting are used, of the cancelled cutting processing.

(4) There is a case where it is desired to eject the booklet, which has been produced by the application of center binding processing and center folding processing to a plurality of paper sheets, to the booklet accommodating portion without being subjected to cutting processing.

(5) In the case where canceling operation has been carried out during the image forming processing or the after-processing by the paper sheet after-processing apparatus, if the center-bound booklet is cut-processed and ejected in spite of the requirement to cancel, a large amount of waste time is consumed.

(6) When the leading edge portion of the paper sheets conveyed to the cutting means by the conveyance means hits the stopping member of the stopping means, the stopping means is given a shock, to have its stopping position deviated, which sometimes cause the paper sheets not to be placed at a correct position.

(7) According to the conventional successively conveying method in which the conveyance of a succeeding booklet is started after the cutting processing of the preceding booklet, the cutting processing time for the booklets becomes long.

(8) Cutting processing should be carried out by setting a required cutting measure regardless of the number of sheets per copy of a booklet.

SUMMARY OF THE INVENTION

It is an object of this invention, through solving the above-mentioned problems and improving the paper cutting apparatus, to accomplish the improvement of the ease of operation and the increase of booklet accommodating capacity of the paper accommodating portion for carrying a finished booklet ejected after having the front end of the bundle of paper sheets cut which have been center-bound and twofold-processed, and making the size of the paper cutting apparatus small.

Accordingly, to overcome the cited shortcomings, the abovementioned object of the present invention can be attained by sheet cutting apparatus described as follow.

(1) A sheet cutting apparatus for cutting a front end portion opposite to a folded portion of a booklet finished by a center folding processing, comprising: a first driving source to drive a conveying device for conveying the booklet; a second driving source to drive a movable stopping device for stopping the booklet at a predetermined position; a third driving source to drive a pressing device for pressing the booklet; a fourth driving source to drive a cutting device for cutting the front end portion of the booklet; a fifth driving source to drive a booklet accommodating device for accommodating the booklet processed by the cutting device; and a controlling section to control each of the first driving source, the second driving source, the third driving source, the fourth driving source and the fifth driving source; wherein the controlling section deactivates all of the first driving source, the second driving source, the third driving source and the fifth driving source, when the controlling section activates the fourth driving source.

(2) A sheet cutting apparatus for cutting a front end portion opposite to a folded portion of a booklet finished by a center folding processing, comprising: a conveying device for conveying the booklet; a stopping device for stopping the booklet at a predetermined position; a cutting device for cutting the front end portion of the booklet; and a controlling section to control each of the conveying device, the stopping device and the cutting device; wherein the controlling section controls the stopping device so as to variably determine a stopping position of the booklet stopped by the stopping device, based on a number of sheets included in the booklet conveyed to the cutting device by the conveying device.

(3) A sheet cutting apparatus for cutting a front end portion opposite to a folded portion of a booklet finished by a center folding processing, comprising: a conveying device for conveying the booklet; a stopping device for stopping the booklet at a predetermined position; a cutting device for cutting the front end portion of the booklet; and a controlling section to control each of the conveying device, the stopping device and the cutting device; wherein the controlling section automatically determines that a cutting processing of cutting the front end portion of the booklet is not performed, when a number of sheets included in the booklet is set at a number lower than a predetermined number of sheets.

(4) The sheet cutting apparatus of item 3, wherein the controlling section automatically performs controlling actions so as not to perform the cutting processing and to inform a fact that the cutting processing is not performed, when a number of sheets included in the booklet is set at a number lower than a predetermined number of sheets.

(5) A sheet cutting apparatus for cutting a front end portion opposite to a folded portion of a booklet finished by a center folding processing, comprising: a conveying device for conveying the booklet; a stopping device for stopping the booklet at a predetermined position; a cutting device for cutting the front end portion of the booklet; a booklet accommodating device for accommodating the booklet processed by the cutting device; and a controlling section to control each of the conveying device, the stopping device, the cutting device and the booklet accommodating device; wherein, when an execution of a cutting processing operation is selected, the controlling section controls the conveying device so as to convey the booklet processed by the cutting device to the booklet accommodating device, and, when a non-execution of the cutting processing operation is selected, the controlling section controls the conveying device so as to convey the booklet to the booklet accommodating device without performing the cutting processing operation.

(6) A sheet cutting apparatus for cutting a front end portion opposite to a folded portion of a booklet finished by a center folding processing, comprising: a conveying device for conveying the booklet; a stopping device for stopping the booklet at a predetermined position; a cutting device for cutting the front end portion of the booklet; a booklet accommodating device for accommodating the booklet processed by the cutting device; and a controlling section to control each of the conveying device, the stopping device, the cutting device and the booklet accommodating device; wherein, when a further execution of an image-forming operation is cancelled in a mid-course of conducting the image-forming operation, the controlling section controls the conveying device so as to convey the booklet to the booklet accommodating device without performing a cutting processing operation by the cutting device.

(7) A sheet cutting apparatus for cutting a front end portion opposite to a folded portion of a booklet finished by a center folding processing, comprising: a conveying device for conveying the booklet; a stopping device for stopping the booklet at a predetermined position; a cutting device for cutting the front end portion of the booklet; a booklet accommodating device for accommodating the booklet processed by the cutting device; and a controlling section to control each of the conveying device, the stopping device, the cutting device and the booklet accommodating device; wherein the controlling section applies a magnetizing processing to a driving source for driving the stopping device to keep the stopping device in a fixed state, just before a leading edge portion of the booklet, being conveyed by the conveying device, is batted against a stopping member of the stopping device.

(8) A sheet cutting apparatus for cutting a front end portion opposite to a folded portion of a booklet finished by a center folding processing, comprising: a conveying device for conveying the booklet; a stopping device for stopping the booklet at a predetermined position; a cutting device for cutting the front end portion of the booklet; a booklet accommodating device for accommodating the booklet processed by the cutting device; and a controlling section to control each of the conveying device, the stopping device, the cutting device and the booklet accommodating device; wherein the controlling section controls the conveying device so as to simultaneously conduct a conveyance processing of the booklet processed by the cutting device and a feed-in processing of a succeeding booklet, by conveying the succeeding booklet into the cutting device while conveying the booklet processed by the cutting device to the booklet accommodating device.

(9) A sheet cutting apparatus for cutting a front end portion opposite to a folded portion of a booklet finished by a center folding processing, comprising: a conveying device for conveying the booklet; a stopping device for stopping the booklet at a predetermined position; a cutting device for cutting the front end portion of the booklet; a booklet accommodating device for accommodating the booklet processed by the cutting device; and a controlling section to control each of the conveying device, the stopping device, the cutting device and the booklet accommodating device; wherein the controlling section adjusts a stopping position of a stopping member of the stopping device corresponding to cutting size set arbitrarily.

Further, to overcome the abovementioned problems, the abovementioned object of the present invention can be attained by image-forming apparatus described as follow.

(10) An image-forming apparatus, comprising: an image-forming section to form an image on a sheet, fed from a sheet feeding device, based on image information; a sheet finishing section, which comprises a binding processor to apply a binding processing to a set of sheets, each of which is the sheet having the image formed by the image-forming section, and a folding processor to apply a folding processing to the set of sheets processed by the binding processor; and the sheet cutting apparatus cited in any one of items 1–9; wherein the image-forming apparatus produces a booklet by applying the binding processing and the folding processing to the set of the sheets, and the cutting device cuts the front end portion of the booklet.

Further, to overcome the abovementioned problems, another image-forming apparatus, embodied in the present invention, will be described as follow:

(11) An image forming apparatus of this invention comprises image forming means for forming an image in accordance with image information on a paper sheet conveyed by paper feeding means, binding means for applying center binding processing to paper sheets on which an image has been formed by said image forming means, paper sheet after-processing apparatus provided with folding means for applying twofold processing to the center-binding-processed paper sheets, and the paper sheet cutting apparatus embodied in the present invention, and it is characterized by it, that a booklet is produced by the application of twofold processing and center binding processing to the paper sheets having an image formed, the booklet is finished by cutting the front end of said booklet by cutting means.

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENT (The First Embodiment)

A paper sheet cutting apparatus of this invention, a paper sheet after-processing apparatus, and an image forming apparatus equipped with the paper sheet cutting apparatus will be explained on the basis of the drawings.

Figure 1:
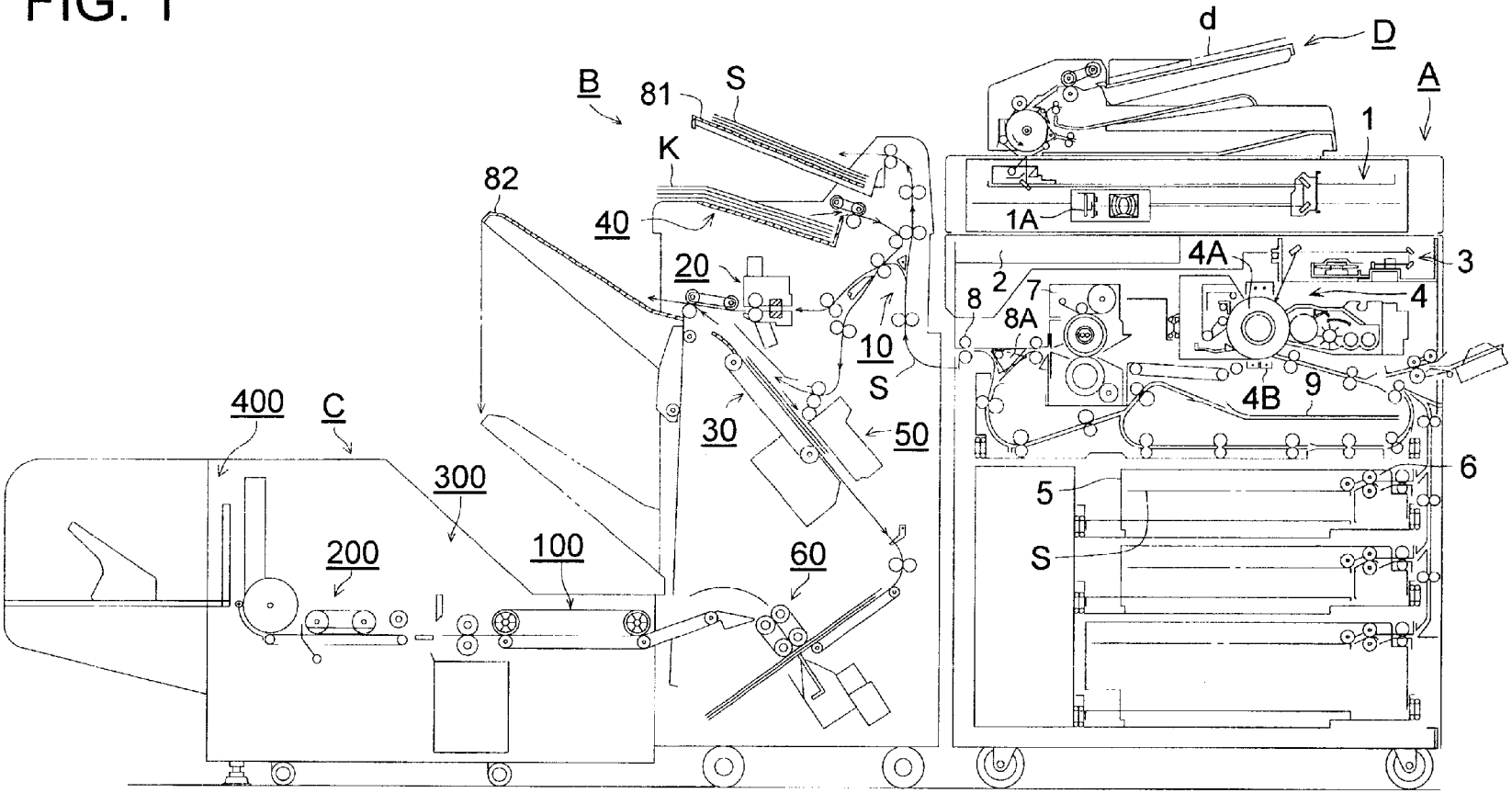
FIG. 1 is a drawing of the overall structure of an image forming system equipped with an image forming apparatus mainframe, a paper sheet after-processing apparatus, and a paper sheet cutting apparatus.

FIG. 1 is a drawing showing the overall structure of an image forming system equipped with the image forming apparatus mainframe A, the paper sheet after-processing apparatus B, and the paper sheet cutting apparatus C.

The image forming apparatus mainframe A shown in the drawing is provided with the image reading section 1, the image processing section 2, the image writing section 3, the image forming section 4, the paper feeding cassettes 5, the paper feeding means 6, the fixing apparatus 7, the ejection section 8, and the automatic duplex copying paper feeding section 9.

On the upper side of the image forming apparatus A, the automatic document feeder D is installed. At the side near the paper ejection section 8, that is, the left side of the image forming apparatus mainframe A shown in the drawing, the paper sheet after-processing apparatus (the finisher) B and the paper sheet cutting apparatus C is connected.

A sheet of a document d placed on the document table of the automatic document feeder D is conveyed in the arrow mark direction, and the image on one side or each image on both sides of the document is projected by the optical system of the image reading section 1 to the CCD image sensor 1A, by which the image is read.

The analogue signal obtained by the photoelectric conversion by the CCD image sensor 1A is subjected to analogue processing, A/D conversion, shading correction, image compression, etc. in the image processing section 2, and after that, the signal is transmitted to the image writing section 3.

In the image writing section 3, the output light from a semiconductor laser irradiates the photoreceptor drum 4A in the image forming section 4, to form a latent image. In the image forming section 4, processes such as charging, exposure, development, transfer, detaching, and cleaning are carried out. Onto the paper sheet S, which has been fed from the paper feeding cassette 5 by the paper feeding means 6, an image is transferred by the transfer means 4B. The paper sheet S carrying the image on it is fixed by the fixing apparatus 7, and is fed into the paper sheet after-processing apparatus B from the paper ejection section 8. In other way, the paper sheet S, which has been processed already for the image on one side and fed into the automatic duplex copying paper feeding section 9 by the conveyance path switching plate 8A, is again processed for the image on the other side; after that, it is ejected from the paper ejection section 8, and after it is subjected to center binding processing and twofold processing in the paper sheet after-processing apparatus B, it is fed into the paper sheet cutting apparatus C.

Figure 3:
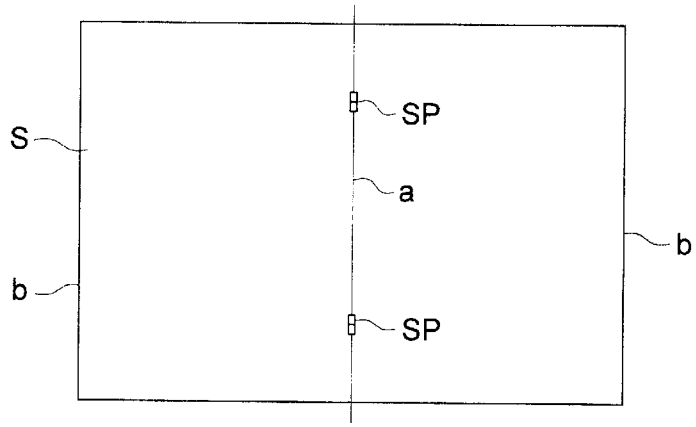
FIG. 3 shows the plan of paper sheets having been subjected to center binding processing, a perspective view of a booklet having been subjected to the after-processing of center binding and two-folding, a perspective view showing a booklet in the fully opened state, and a cross-sectional view of a booklet.
Figure 3:
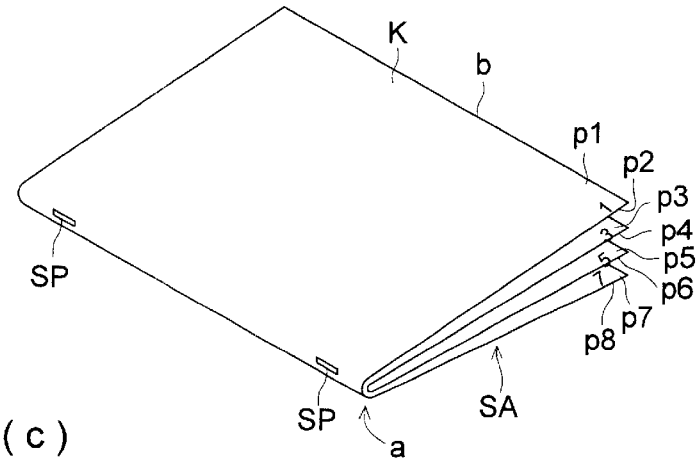
Figure 3:
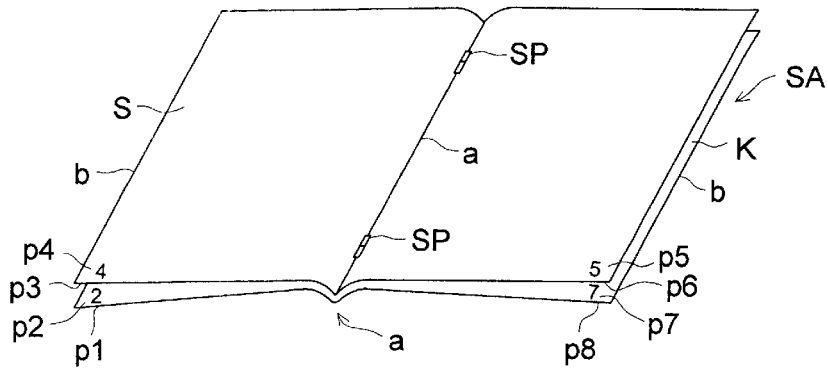
Figure 3:
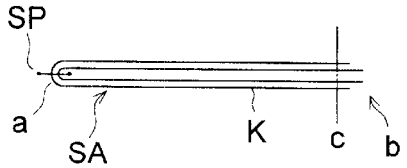

The paper sheet cutting apparatus C is one that trues up the front end b, as shown in FIG. 3(*d*), by cutting the portion close to the front end of the booklet SA, which has been produced by center binding processing and twofold processing by the paper sheet after-processing apparatus B, and will be described in detail in FIG. 4. and after that.

In the paper sheet after-processing apparatus B, there are arranged approximately in the vertical direction from the top in the drawing, the fixed ejected paper tray 81, the cover sheet feeding means 40, the shift processing conveyance portion 20, the first stacking portion 30, the binding means 50, and the folding means 60.

In the upper right portion of the paper sheet after-processing apparatus B shown in the drawing, the entrance conveyance portion 10 is arranged. Further, at the left side of the paper sheet after-processing apparatus B shown in the drawing, there is arranged the up-and-down moving ejected paper tray 82 for stacking the paper sheets, for which end binding processing and shift processing have been finished.

Figure 2:
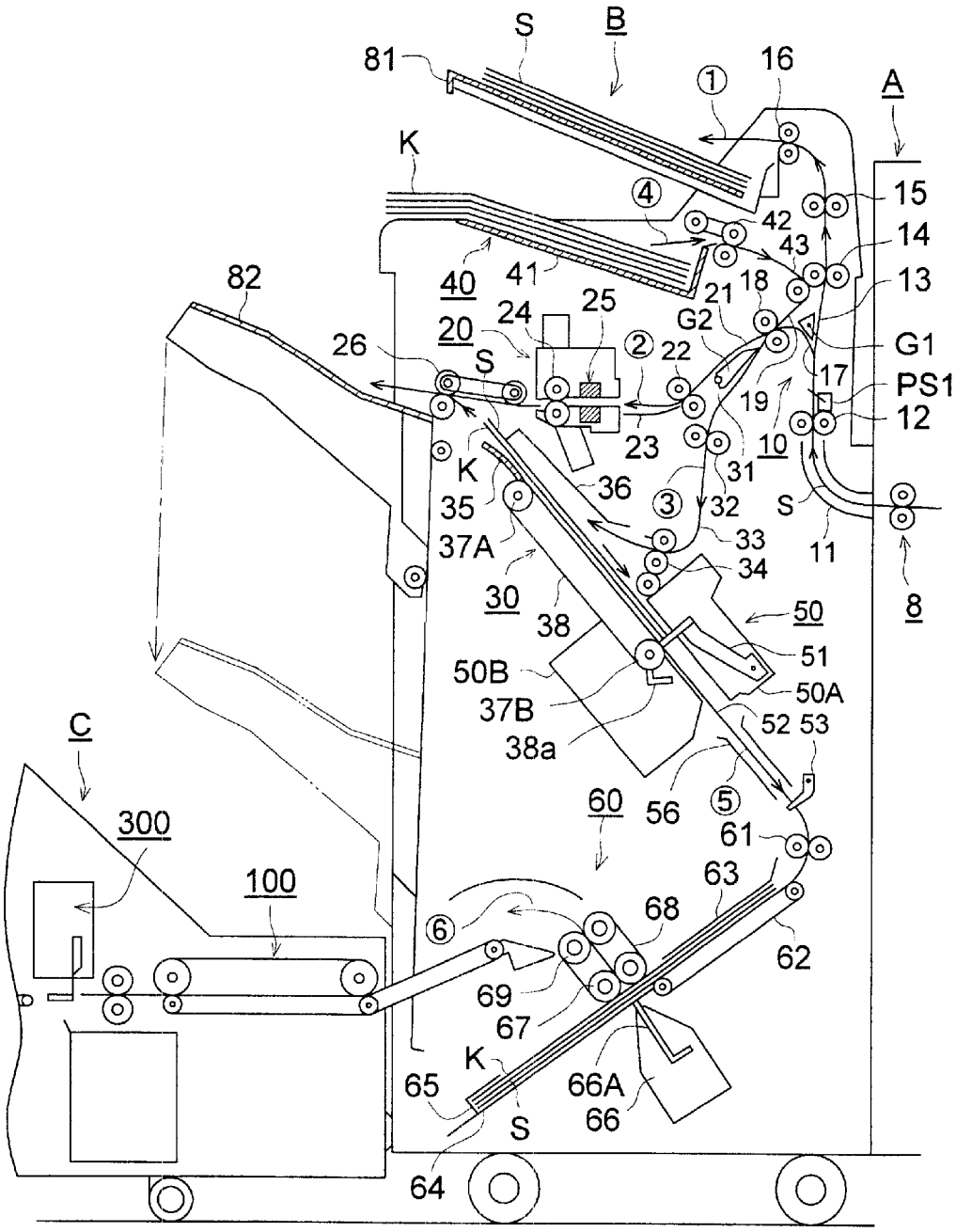
FIG. 2 is a schematic drawing showing the paper conveyance paths in a paper sheet after-processing apparatus.

FIG. 2 is a schematic drawing showing the paper conveyance paths in the paper sheet after-processing apparatus B.

The paper sheet after-processing apparatus B is installed with its position and height adjusted in such a way that the entrance portion 11 for the paper sheet S which has been conveyed out from the image forming apparatus mainframe A coincides with the paper ejection section 8 of the image forming apparatus mainframe A.

The pathway for the paper sheet S, which is connected to the downstream side of the entrance rollers 12 with respect to the paper conveying, forks into three ways, that is, the first path (1) in the upper part, the second path (2) in the middle, and the third path (3) in the lower part, and the paper sheet S is fed into any one of the paths by the selection of the angles made by the switching gates G1 and G2.

(1) NON-STAPLE AND NON-SORT (FIRST PATH (1))

The paper sheet S, which has the image on it already processed and has been ejected from the image forming apparatus mainframe A, is introduced into the entrance portion 11, is conveyed by the entrance rollers 12, and has its length in the conveying direction detected by the entrance portion sensor PS1. The paper sheet S passes through the path 13 at the right side of the first switching gate G1 located above, is conveyed upward as gripped by the conveyance roller pairs 14 and 15 located above, is further gripped by the ejection rollers 16 to be ejected onto the fixed ejected paper tray 81 on the upper side outside the machine, and is stacked on the preceding one.

In this paper conveying process, the switching gate G1 closes the path 17, and brings the path 13 into the open state, to make it possible for the paper sheet S to pass it to the fixed ejected paper tray 81.

(2) SHIFT PROCESSING OR NON-SORTING (SECOND PATH (2))

When the apparatus is set at this mode, the switching gate G1 closes the path 13, keeps the path 17 in the open state, to make it possible for the paper sheet S to pass through the path 17.

The paper sheet S, which has the image on it already processed and has been ejected from the image forming apparatus mainframe A, passes the entrance portion 11 and the entrance rollers 12, passes the path 17 formed in the open state under the switching gate G1, is gripped by the conveyance rollers 18, passes the second path (2), that is, the path 21 above the second switching gate G2 located obliquely below, is gripped by the conveyance rollers 22, passes the path 23, is gripped by the shift means 25 and the shift roller 24, is ejected by the ejection rollers 26, and is stacked on the up-and-down moving ejected sheet tray 82 which is capable of accommodating a large quantity of paper sheets.

(3) EDGE BINDING PROCESSING (THIRD CONVEYANCE PATH (3))

The paper sheet S to be subjected to edge binding processing or center binding processing is subjected to image formation processing in the image forming apparatus mainframe A, is fed into the entrance portion 11 of the paper sheet after-processing apparatus B, passes the entrance rollers 12 and the path 17 under the first switching gate G1, is gripped by the conveyance rollers 18, and is conveyed to the third conveyance path (3).

In the third conveyance path (3), the paper sheet S passes the path 31 below the switching gate G2, and is gripped and conveyed by the conveyance rollers 32 located at the downstream side. The paper sheet S is gripped and conveyed out by the conveyance rollers 34 located at further downstream position, is ejected into the space over the intermediate stacker 35 which is disposed in a tilted way in the first stacking portion 30, is brought into contact with the upper surface of the intermediate stacker 35 or the paper sheet S stacked on the intermediate stacker 35, and glides on it upward; then, after the trailing edge with respect to the moving direction of the paper sheet S is ejected, the paper sheet S changes its direction downward by its own weight, glides down on the tilted surface of the intermediate stacker 35, and is stopped by it that the leading edge with respect to the moving direction of the paper sheet S hits the paper stopping surface of the movable stopper member for edge binding (hereinafter referred to as the edge binding stopper) 51 located in the neighborhood of the binding means 50.

36 denotes a pair of width adjusting means in the upstream side provided in a movable way on the both side surfaces of the intermediate stacker 35. The width adjusting means in the upstream side 36 is movable in the direction perpendicular to the direction of paper conveying, and at the time of receiving paper sheets when the paper sheet S is ejected onto the intermediate stacker 35, it is opened wider than the width of the paper sheet, and when the paper sheet S is conveyed on the intermediate stacker 35 and hits the edge binding stopper 51 to stop, it taps lightly the paper sheet S on the side end in the width direction, to carry out the truing up of the width of a bundle of paper sheets (width adjustment).

At this stop position, a specified number of paper sheets S is stacked and adjusted on the intermediate stacker 35, binding processing is carried out by the binding means 50, and the bundle of paper sheets is bound together.

In a part of the paper stacking surface of the above-mentioned intermediate stacker 35, the plurality of ejection belts 38 which are entrained around the driving pulley 37A and the driven pulley 37B is disposed in such a manner as to be capable of revolution. The bind-processed bundle of paper sheets is placed on the ejection belt 38 with its trailing edge held by the ejection finger 38a of the ejection belt 38, glides on the stacking surface of the intermediate stacker 35 to be pushed obliquely upward, and progresses to the nip position of the ejection rollers 26. The bundle of paper sheets gripped by the rotating ejection rollers 26 is ejected and stacked on the up-and-down moving ejected paper tray 82.

(4) COVER SHEET FEEDING (FOURTH PATH (4))

The cover sheet feeding means 40 is composed of the cover sheet stacking portion 41 and the cover sheet feeding portion 42.

A sheet of the cover sheet K, which has been fed from the cover sheet feeding means 40, passes the path 43, and passes the left nip position of the conveyance rollers 14; after it passes the path 19 and the conveyance rollers 18, it passes through the conveyance rollers 32, path 33, and the conveyance rollers 34 of the third conveyance path (3), and arrives at on the intermediate stacker 35.

(5) CENTER BINDING PROCESSING (FIFTH CONVEYANCE PATH (5))

The binding means 50 has a structure that is divided into two divisional portions, the upper mechanism 50A and the lower mechanism 50B, and between them, the path 52 that the paper sheet S is able to pass is formed.

Regarding the binding means 50, two sets of them are arranged in the direction perpendicular to the paper conveying direction, and by the driving means not shown in the drawing, they are movable in the direction perpendicular to the paper conveying direction. By this binding means 50, a binding staple SP is driven in at each of the two positions at an equal distance from the center in the width direction of the paper sheet.

When the apparatus is set in center binding mode, and the sizes of the cover sheet K and paper sheet S (the length in the conveying direction) is set or detected, the movable stopper member for center binding (hereinafter referred to as the center binding stopper) 53 moves to the specified position and stops. Linked to the actuation of the center binding stopper 53, the edge binding stopper 51 is retracted, to open the path 52.

After the cover sheet K is placed at the specified position on the intermediate stacker 35, the paper sheets S, which have been conveyed out from the image forming apparatus mainframe A, pass the third conveyance path (3) from the entrance conveyance portion 10 of the paper sheet after-processing apparatus B, are stacked successively on the upper surface of the cover sheet K placed on the intermediate stacker 35, and their positions are determined by it that the end portions of the paper sheets S hit the center binding stopper 53. 56 denotes the width adjusting means in the downstream side for regulating the width direction of the paper sheets S in the case of center binding processing, and in the same way as the above-mentioned width adjusting means in the upstream side 36, at every time when each one of the paper sheets S is conveyed in, it carries out width adjustment by tapping the paper sheets S on the side end in the width direction.

Further, in the case of center binding processing, for the paper sheet S, which is conveyed on the intermediate stacker 35 and is moving in the upstream side of the binding means 50, at an estimated timing when the paper sheet S hits the center binding stopper 53, by actuating the width adjusting means in the upstream side 36 and the width adjusting means in the downstream side 56 simultaneously, the width adjustment of the paper sheets is carried out to true up them.

In this way, the paper sheets S and the cover sheet K, which move on the intermediate stacker 35 and are stacked as extended over it from the upstream side to the downstream side with the binding means 50 positioned at its center, are exactly adjusted for the width over the whole length of the paper sheet S, by the width adjusting means in the upstream side 36 and the width adjusting means in the downstream side 56.

After the last paper sheet S is positioned correctly and placed on the intermediate stacker 35, the center binding processing is applied to the bundle of paper sheets composed of the cover sheet K and all of the paper sheets S by the binding means 50. By this center binding processing, staples are driven in at the central portion with respect to the conveying direction of the cover sheet K and the paper sheets S. The staples SP are driven in from the lower mechanism 50B having the staple driving member toward the upper mechanism 50A having the staple clinching member.

(6) TWOFOLD PROCESSING (SIXTH CONVEYANCE PATH (6))

After center binding processing, the center binding stopper 53 oscillates to open the path in the downstream side of the path 52. The bundle of paper sheets, which is composed of the cover sheet K and the paper sheets S and has been subjected to center binding processing, passes the curved path and the conveyance rollers 61, and is conveyed by the conveyance belt 62 located obliquely below as guided by the guide plate 63; further, it is conveyed on the second stacking portion (the stacking table) 64, and is stopped at the specified position by it, that its leading edge with respect to the conveying direction comes into contact with the movable stopper means of the folding portion 65. The movable stopper means of the folding portion 65 is capable of moving to the specified position by the setting or the detection of the paper sheet size and the driving means.

The folding means 60 is composed of the paper sheet thrusting-out means 66, folding rollers 67, the conveyance belts 68, the pressing rollers 69, etc.

By the twofold start signal, the thrusting plate 66A of the paper sheet thrusting-out means 66 moves straight obliquely upward, and the front end portion of the thrusting plate 66A pushes up the central portion of the bundle of paper sheets composed of the cover sheet K and the paper sheets S, to broaden the nip portion of the folding rollers 67 through the bundle of paper sheets, which makes the rollers oscillate and be separated.

After the front end portion of the thrusting plate 66A passes the above-mentioned nip portion, the thrusting plate 66A is retracted, and the central portion of the bundle of the paper sheets is pressed from both sides by the folding rollers 67, to form a fold portion. This fold portion coincides with the driving position of the staples in the bundle of paper sheets by the above-mentioned center binding processing. This center binding-and-center folding processing is capable of processing 64 pages (16 sheets) of paper sheets at the maximum.

The central portion of the bundle of paper sheets, which has a fold portion formed by being pressed from both sides by the pair of rotary folding rollers 67, is conveyed as gripped by the pair of conveyance belts 68, and is fed into the nip position of the pair of pressing rollers 69; then, at this position, after the fold is further made secure, the bundle is ejected out.

FIG. 3(*a*) is the plan of a paper sheet showing the center binding processing in which the staples SP are driven in at the two positions at equal distance from the center along the fold line for two-folding of the paper sheet S, FIG. 3(*b*) is a perspective view of the booklet SA which has been subjected to the after-processing of center binding and two-folding, FIG. 3(*c*) is a perspective view showing the fully opened state of the booklet SA for which the after-processing has been finished, and FIG. 3(*d*) is a cross-sectional view of the booklet SA to which the after-processing of center binding and two-folding has been applied. In these drawings, b denotes the front end of the paper sheet S, and c denotes the cutting line for truing up the front end.

In the booklet SA, which has been produced by center binding processing and twofold processing, the first side (p. 1 and p. 8) of the cover sheet K faces outward, the second side (p. 2 and p. 7) comes to the rear side of the first side, further to the inside of them, the first side of the paper sheet S, the content of the booklet SA, (p. 3 and p. 6) comes, and further to the inside of them, the second surface of the paper sheet S (p. 4 and p. 5) comes; the collating of the booklet composed of 8 pages (p. 1 to p. 8) can be made as shown in the drawings.

When the automatic booklet making mode is selected and set in the operation panel of the image forming apparatus mainframe A, the cover sheet K is placed on the cover sheet placing portion 41, and printing is started, by the control section of the image forming apparatus mainframe A, the above-mentioned image forming process is practiced, the paper sheets S carrying an image are subjected to center binding processing and twofold processing by the paper sheet after-processing apparatus B, and the booklets sA are produced and ejected successively.

When the manual booklet making mode is selected and set in the operation section of the paper sheet after-processing apparatus B, the cover sheet K and the paper sheets S, which have already an image formed, for one copy of the booklet under it are stacked on the cover sheet placing portion 41, and the conveying out operation is started, by the control section of the paper sheet after-processing apparatus B, the cover sheet k and the paper sheets S are subjected to center binding processing and twofold processing by the paper sheet after-processing apparatus B, and one copy of the booklet SA is produced and ejected.

Figure 4:
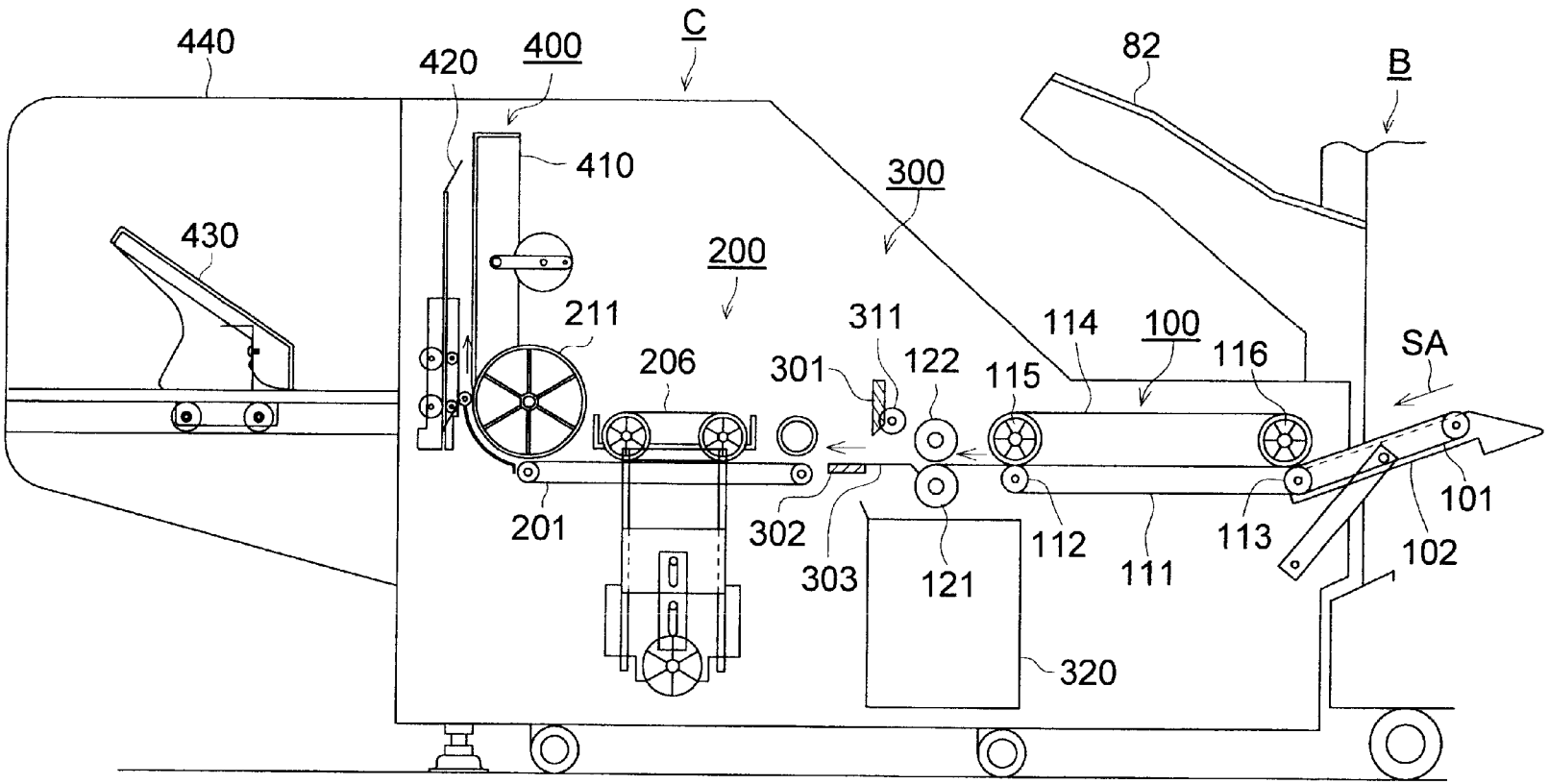
FIG. 4 is a drawing showing the overall structure of a paper sheet cutting apparatus of this invention.

FIG. 4 is a drawing showing the overall structure of the paper sheet cutting apparatus C of this invention. The paper sheet cutting apparatus C is composed of the first conveyance means (the paper conveyance means before cutting processing) 100, the second conveyance means (the paper conveyance means after cutting processing) 200, the cutting means 300, and the booklet accommodating means 400.

Figure 5:
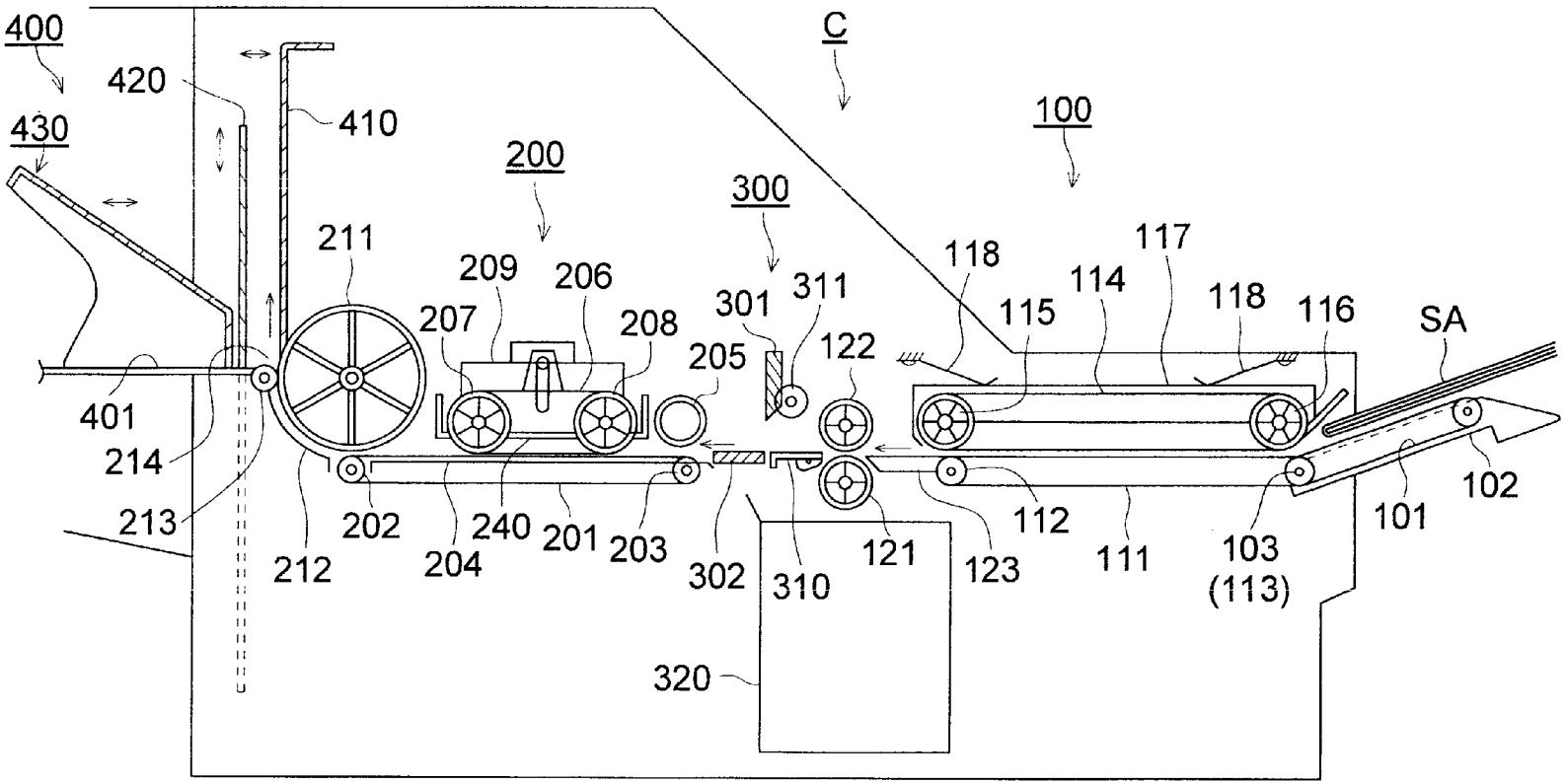
FIG. 5 is a cross-sectional view showing the paper conveyance paths in a paper sheet cutting apparatus.

FIG. 5 is a cross-sectional view showing the paper conveyance paths in the paper sheet cutting apparatus C.

The booklet SA, which has been subjected to twofold processing by the folding means 60 of the paper sheet after-processing apparatus B, is ejected onto the conveyance belt 101 arranged at the entrance portion of the paper sheet cutting apparatus C. The conveyance belt 101 is supported in such a way that it is capable of revolution by the supporting member 102, and is made to revolve by the driving roller 103.

In the downstream side with respect to the conveying direction of the conveyance belt 101, the lower conveyance belt 111, which is entrained around the driving roller 112 and the driven roller 113, is arranged in such a way that it is capable of revolution. Over the lower conveyance belt 111, the upper conveyance belt 114 is arranged in pressing contact with the lower conveyance belt 111 and is driven to revolve. The upper conveyance belt, which is entrained around the rollers 115 and 116, is supported by the supporting member 117 in such a way that it is capable of revolution. The supporting member 117 is urged by the spring 118, and brings the upper conveyance belt 114 into pressing contact with the lower conveyance belt 111. The booklet SA, which has been conveyed by the conveyance belt 101, is conveyed as pressed and gripped by the lower conveyance belt 111 and the upper conveyance belt 114.

In the downstream side with respect to the paper conveying direction of the lower conveyance belt 111, the driving roller 121 connected to the driving means and the driven roller 122 rotated by the pressing contact with the driving roller 121 are disposed. The booklet SA, which is conveyed as gripped by the lower conveyance belt 111 and the upper conveyance belt 114, passes the guide plate 123, and is conveyed as gripped by the driving roller 121 and the driven roller 122.

In the downstream side with respect to the paper conveying direction of the driving roller 121, the cutting means 300 composed of the upper cutting blade 301, lower cutting blade 302, movable plate 310, the pressing roller 311, the trash box 320, and the driving means is arranged. The detail of the cutting means 300 will be described later.

The booklet SA, which has been finished, with its front end b cut by the cutting means 300, is conveyed as gripped by the revolving lower conveyance belt 101, the upper conveyance belt 206 being driven to revolve, and the upper roller 205 rotating for driving, in the second conveyance means 200.

The lower conveyance belt 201 is made to revolve by the driving roller 202 connected to the driving means. 203 denotes the driven roller which is driven to rotate by the lower conveyance belt 201. In the neighborhood of the booklet conveyance path inside the lower conveyance belt 201, the conveyance supporting plate 204 is fixedly provided.

The upper conveyance belt 206 is entrained around the rollers 207 and 208, is capable of revolution, and is supported by the supporting member 209. The supporting member 209 is spring-urged and presses the upper conveyance belt 206 to the conveyance supporting plate 204 through the lower conveyance belt 201. The booklet SA, which has been subjected to cutting processing, passes the clearance between the lower conveyance belt 201 and the upper roller 205 in the second conveyance means 200, and further, is conveyed as pressed and gripped by the lower conveyance belt 201 and the upper conveyance belt 206.

The booklet SA, which is conveyed in the horizontal direction by the lower conveyance belt 201, is guided by the rotating roller 211 having a large diameter and the fixedly arranged guide plate, is deflected about 90° upward in the vertical direction, and is conveyed upward. The booklet SA is further passes the booklet ejecting opening 214 to be ejected as gripped by the large diameter roller 211 and the pinch roller 213, and is placed on the booklet carrying table 401 of the booklet accommodating means 400, with its fold portion positioned above and its front end b positioned below.

The booklet accommodating means 400 is composed of the booklet carrying table 401, the movable wall member (the pusher) 410, the partition member (the holder) 420, the pressing wall member 430, and the driving means.

The booklet carrying table 401 receives a plurality of copies of the booklet SA, which have already been cut-processed, from the booklet ejecting opening 214 successively, and carries them with the fold portion positioned above and the paper sheets superposed on one another. The movable wall member 410 stands upright on the booklet carrying table 401, is supported in such a way that it is capable of horizontal moving, presses the cover sheet surface of the booklet SA stacked on the booklet carrying table 401, and moves back and forth in the horizontal direction between on the booklet carrying table 401 and the booklet ejecting opening 214.

The movable wall member 410 usually supports the booklet SA carried on the booklet carrying table 401 at a stop position that is a little advancing from the booklet ejecting opening 214, and is retracted to a position to make the booklet ejecting opening open every time when the booklet SA having been cut-processed is conveyed to the booklet carrying table 401; after the booklet SA has finished passing the booklet ejecting opening 214, it returns to the stop position as pressing the cover sheet surface of the booklet SA, and remains on standby.

The partition member 420 is capable of moving in the vertical direction which is orthogonal to the booklet carrying table 401. When the movable wall member 410 starts to retract so as to make the booklet ejecting opening 214 opened for receiving the next booklet, the partition member 420 supports the cover sheet surface of the booklet SA that has been al ready carried in place of the movable wall member 410, and in accordance with the operation of the movable wall member to advance to the stop position as pressing the cover sheet surface of the next booklet SA, the partition member 420 starts descending along the rear end portion of the booklet carrying table 401 to retract, to make it possible to receive the next booklet SA on the booklet carrying table 401. In synchronism with the completion of the movement of the movable wall member 410 to the stop position, the partition member 420 starts to move upward.

The pressing wall member 430 stands upright on the booklet carrying table 401, is supported in a movable manner, and is urged by a spring. The booklet touching surface of the pressing wall member 430 is opposite to the movable wall member 410 or the partition member 420, and presses and holds the surface of the cover sheet of the booklet SA carried on the booklet carrying table 410.

Figure 6:
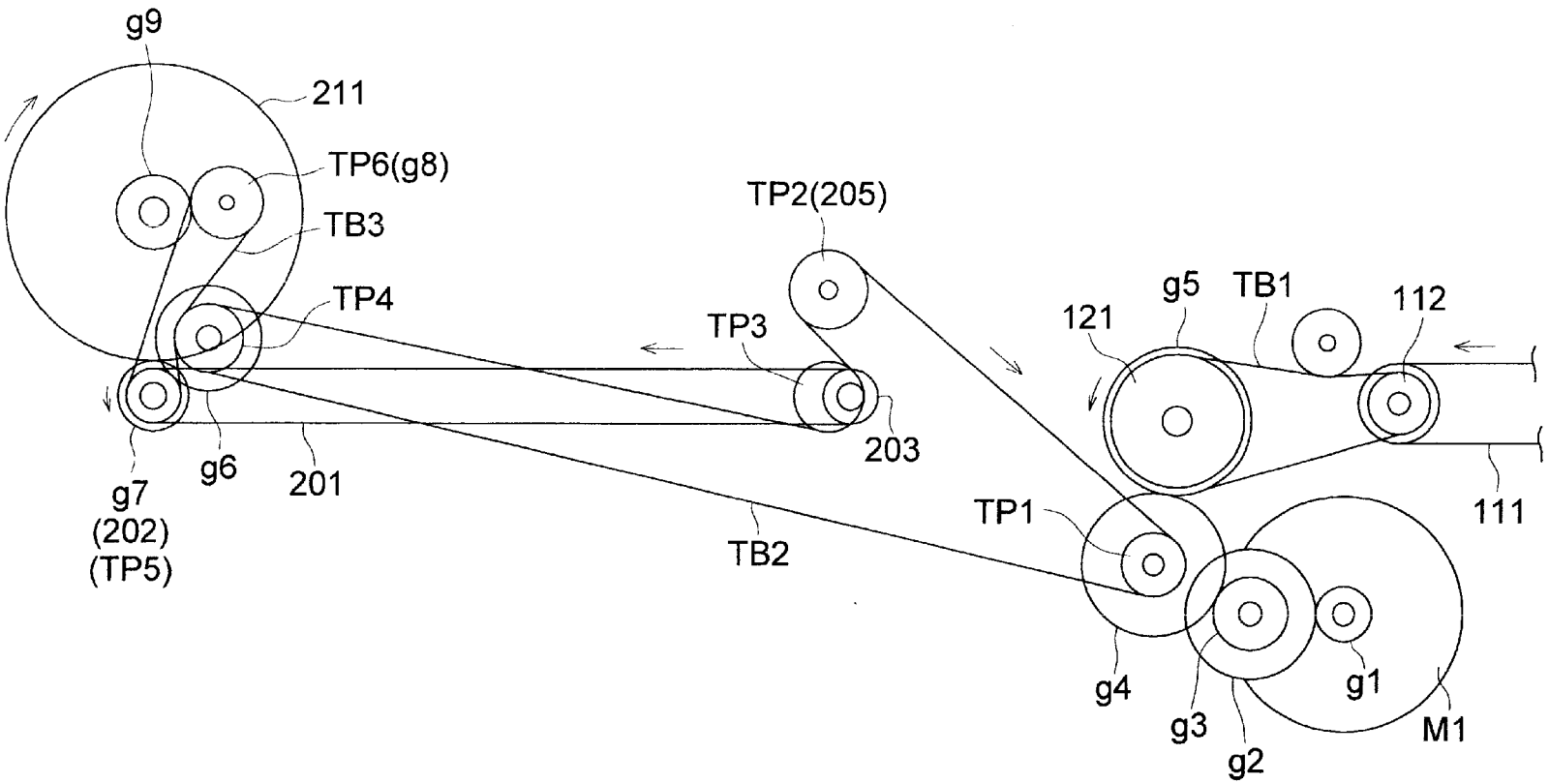
FIG. 6 is a drawing showing the structure of the driving means of a booklet conveyance system.

FIG. 6 is a drawing showing the structure of the driving means of the booklet conveyance system.

The motor M1 for conveying booklets drives the first conveyance means 100 and the second conveyance means 200. The gear g1, which is provided on the driving shaft of the motor M1 for conveying a booklet, rotates the driving roller 121 of the first conveyance means 100 through the gears g2, g3, g4, and g5. The driving roller 121 rotates the driving roller 112 through the belt TB1, and makes the lower conveyance belt 111 revolve.

The belt TB2, which is entrained around the pulley TP1 provided on the same shaft as the gear g4, is also entrained around the pulleys TP2, TP3, and TP4, and is capable of revolving. On the rotary shaft of the pulley TP2, the upper roller 205 is fixed and is able to rotate. The gear g6, which is fixed on the rotary shaft of the pulley TP4, rotates the gear g7 fixed on the rotary shaft of the driving roller 202. The driving roller 202 makes the lower conveyance belt 201 revolve.

The belt TB3, which is entrained around the pulley TP5 fixed on the rotary shaft of the driving roller 202 and the pulley TP6 provided on the intermediate shaft, rotates the large diameter roller 211 fixed on the rotary shaft of the gear g9 through the gears g8 and g9 which are fixed on the rotary shaft of the pulley TP6.

Figure 7:
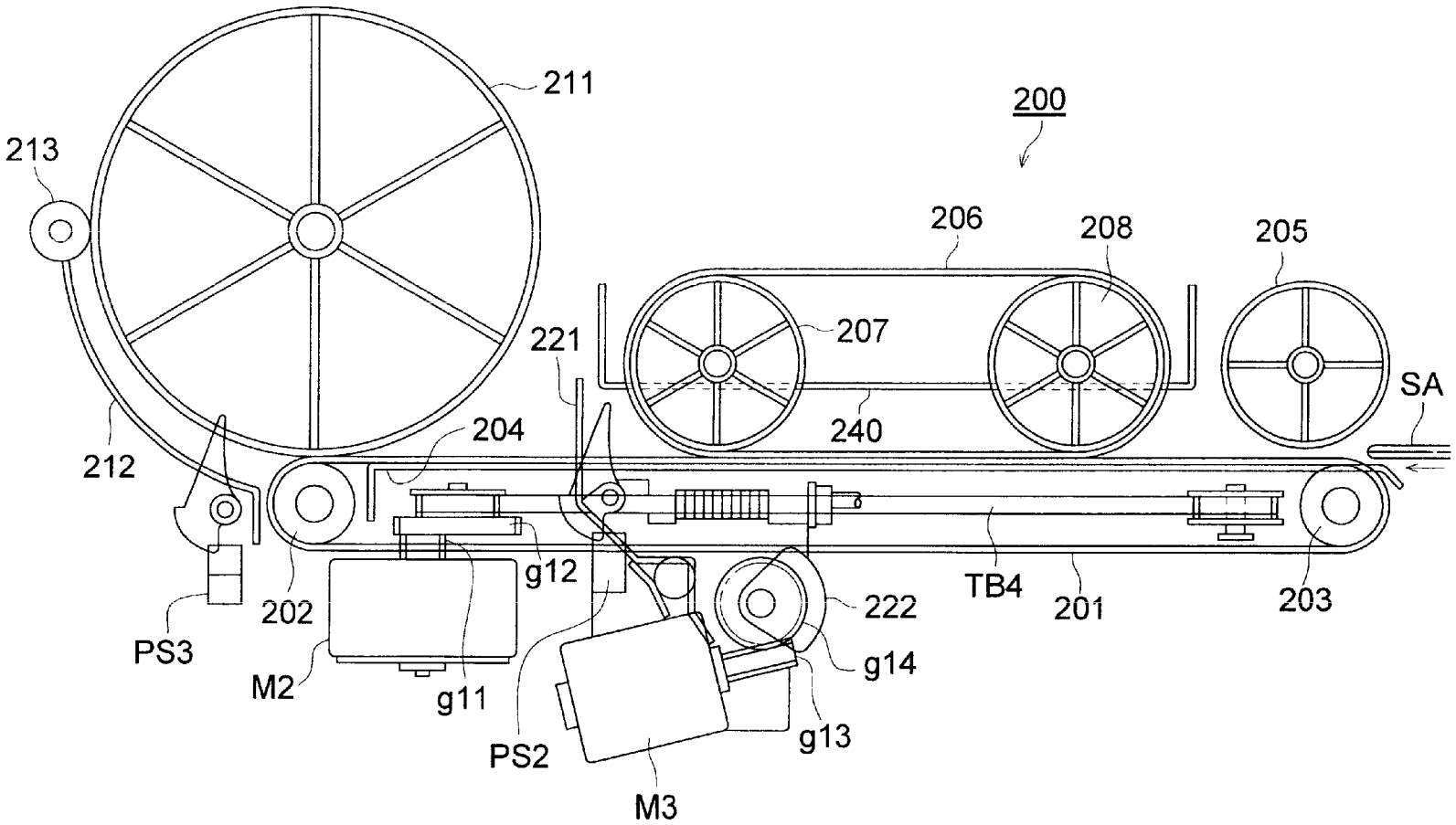
FIG. 7 is a cross-sectional view showing the driving means of the lower conveyance belt and the movable stopper of the second conveyance means.

FIG. 7 is a cross-sectional view showing the driving means for the lower conveyance belt 201 and the movable stopper 221 of the second conveyance means 200.

The motor M2 for moving the movable stopper moves the movable stopper 221 to the specified position corresponding to the paper size through the gears g11 and g12 and the belt TB4. The motor M3 for releasing the stopper drives to rotate the cam 222 through the gears g13 and g14, and makes the movable stopper 221 rise and fall. The movable stopper 221 is kept in the initial state of rising when the front end portion of the booklet SA is expected to hit it, and is brought into the state of falling by the driving of the motor M3 when the booklet SA is ejected.

Because the projection amount of the front end of the booklet SA before cutting the booklet is different depending on the thickness of the booklet SA, that is, the thickness of one sheet of the paper and the number of sheets of the bundle of paper sheets, for the setting position of the movable stopper 221, the control means selects an optimum value on the basis of these numerical set values or the detected thickness of the booklet.

Figure 8:
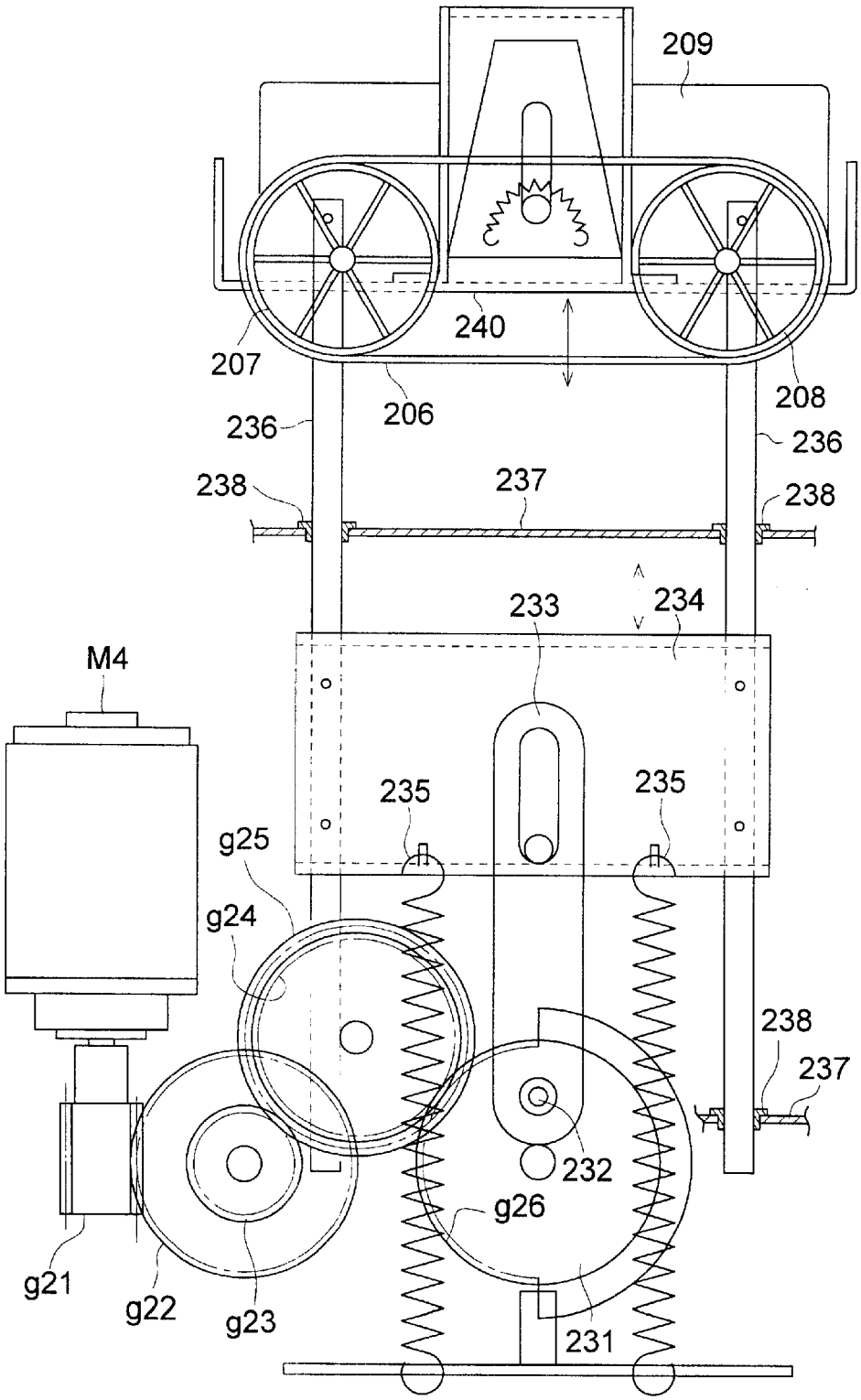
FIG. 8 is the front view of the pressing unit including the upper conveyance belt.

FIG. 8 is the front view of the driving means for the pressing unit including the upper conveyance belt 206. The motor M4 for pressing rotates the rotary disk 231 through the gears g21, g22, g23, g24, g25, and g26. The eccentric pin 232, which is planted in the rotary disk 231, is connected to the lower end portion of the crank 233, to oscillate the crank 233. The upper end portion of the crank 233 is connected to the coupling plate 234, to move the coupling plate 234 up and down. The coupling plate 234 is urged downward in the drawing by the two springs 235.

The two linking rods 236, which are fixed to the both side portions of the coupling plate 234 respectively, are fitted in the bearings 238 fixed to the fixed frame members 237, and are supported in such a way that they are capable of moving up and down. The upper end portions of the linking rods 236 are fixed to the pressing member 240.

The pressing member 240 is spring-urged to the supporting member 209 which supports the upper conveyance belt 206, and is supported in such a way that it is able to move up and down. When the front end of the booklet SA placed on the lower conveyance belt 201 is cut, the pressing member 240 moves up and down by the driving rotation of the rotary disk 231 through the crank 233, the coupling plate 234, and the linking rods 236. Further, the pressing member 240 moves in accordance with the thickness of the booklet SA, and presses the upper surface of the booklet SA.

Figure 9:
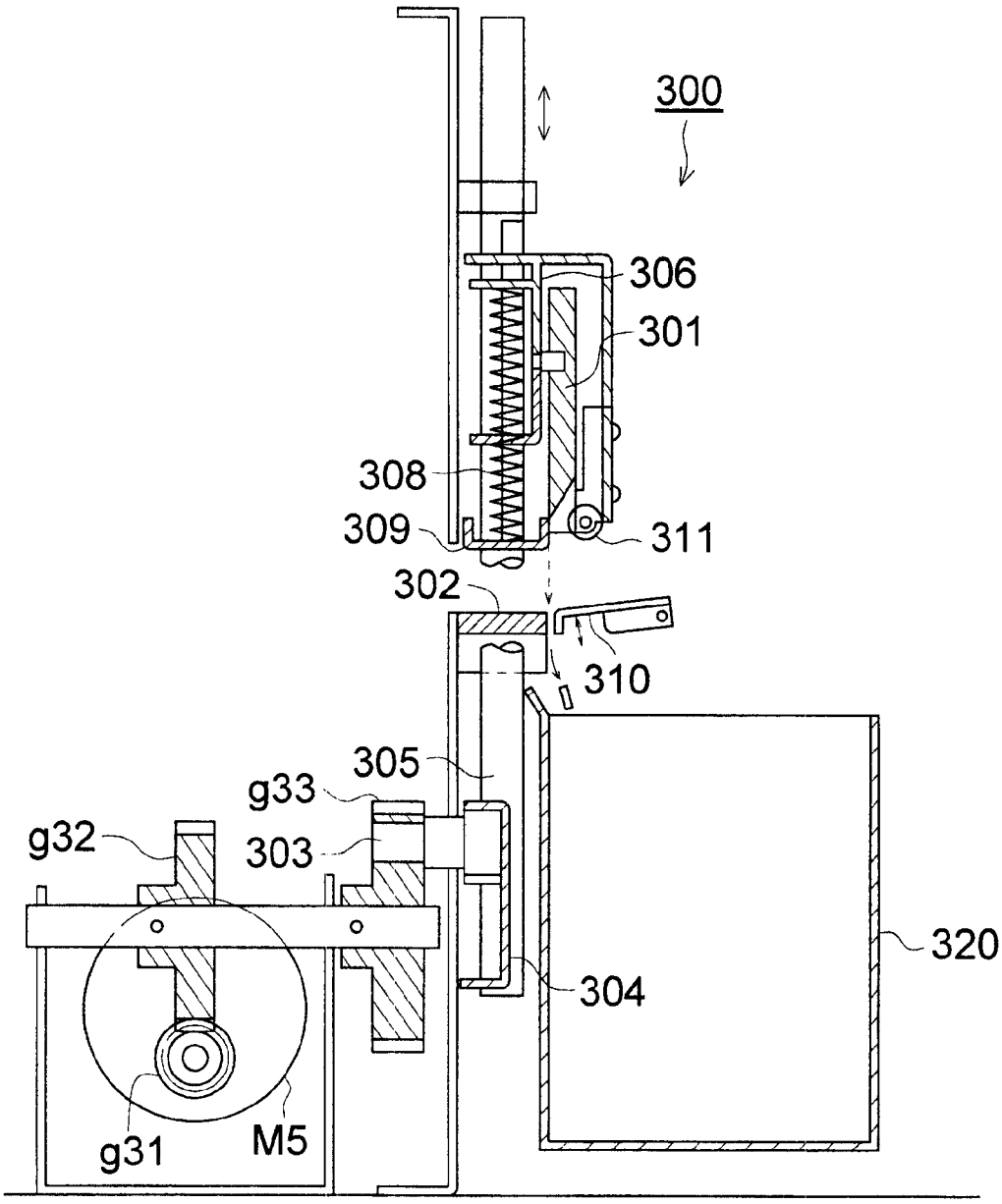
FIG. 9 is a cross-sectional view of the cutting means.

FIG. 9 is a cross-sectional view of the cutting means 300.

The cutting means 300 is composed of the upper cutting blade 301, the lower cutting blade 302, and the driving means for driving the upper cutting blade in such a way that it is capable of moving up and down.

The motor M5 for cutting rotates the gears g31, g32, and g33, and eccentrically rotates the eccentric pin 303 planted at an eccentric position of the gear 33. The front end portion of the eccentric pin 303 slides on the inner peripheral surface of the movable member 304, to make the movable member move up and down.

At the upper portion of the up-and-down moving shaft 305, which is integral with the movable member 304 and supported in such a manner that it is capable of moving up and down, the upper blade supporting frame member 306 is fixed. The upper cutting blade 301 is fixed to the upper blade supporting frame member 306.

The front end of the booklet SA is cut by the edge of the descending upper cutting blade 301 and the edge of the lower cutting blade at the fixed position. 320 denotes the trash box for accommodating the cut waste from the front end.

The pressing plate 309 is supported by the upper blade supporting frame member 306 as urged by the spring 308. At the bottom of the upper blade supporting frame member 306, the pressing roller 311 for pressing the movable plate 310 is supported.

In the descending process of the lower blade supporting frame member 306, the pressing plate 309 descends, to press the upper surface of the booklet SA placed on the lower cutting blade 302, and next, the descending pressing roller 311 presses the movable plate 310, and the edge of the upper cutting blade 301 cuts the front end b.

Figure 10:
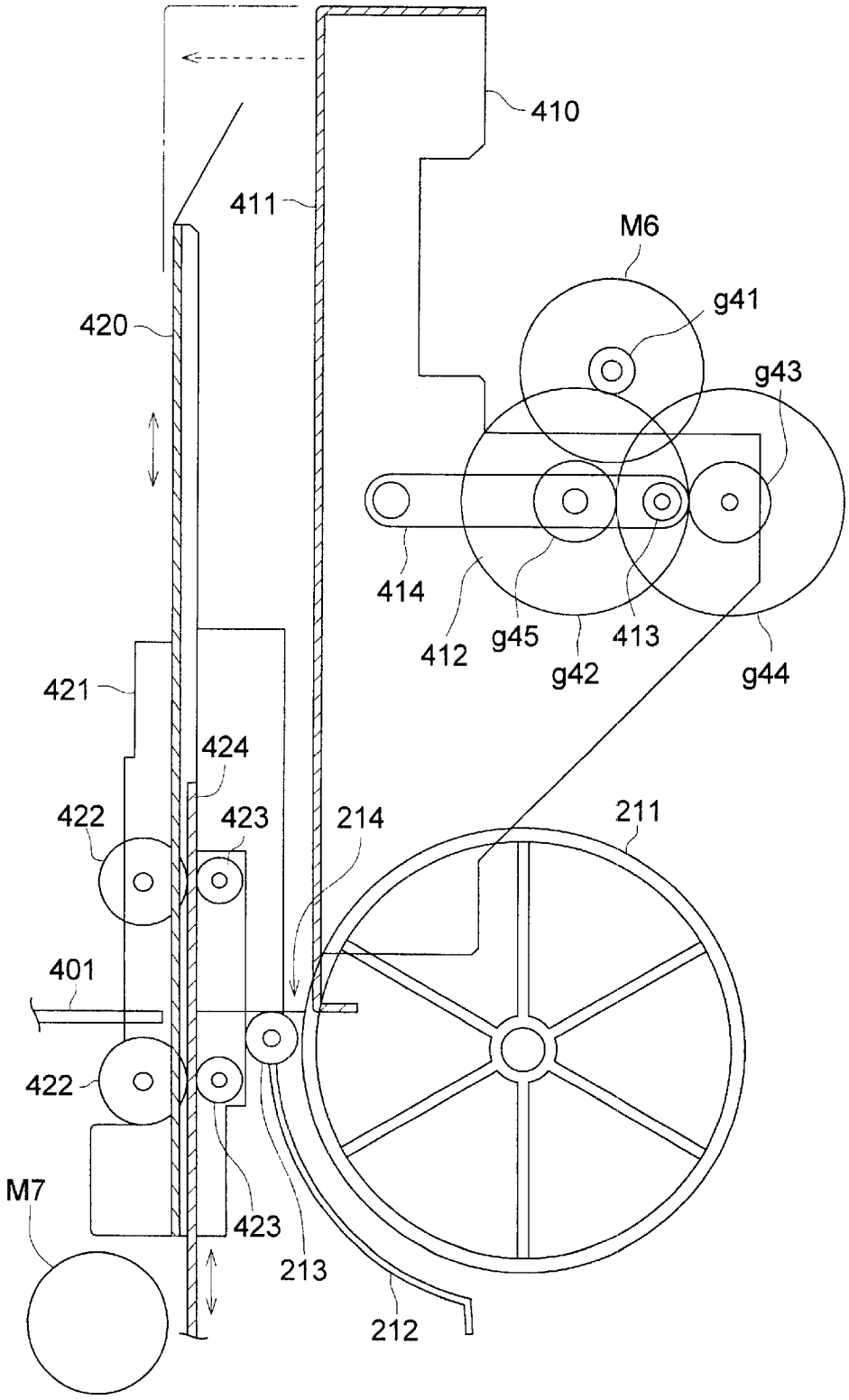
FIG. 10 is a cross-sectional view showing the movable wall member and the partition member in the neighborhood of the booklet ejection opening.

FIG. 10 is a cross-sectional view showing the movable wall member (hereinafter referred to as the pusher) 410, and the partition member (hereinafter referred to as the holder) 420 in the neighborhood of the booklet ejecting opening 214.

The pusher 410 comprises the upright vertical wall portion 411 for pressing the carried booklet SA, and is capable of horizontal moving to the direction of the booklet carrying table 401. The motor M6 for moving the pusher rotates the rotary disk 412 through the gears g41, g42, g43, g44, and g45. The eccentric pin 413, which is planted at the eccentric position of the rotary disk 412, is connected to the right end portion of the crank 414, to oscillate the crank 414. The left end portion of the crank 414 shown in the drawing is connected to the pusher 410, to move the pusher 410 in the horizontal direction. The pusher 410 as shown by the solid line in the drawing shows that it is located at the retracted position, that is, it is in the state to make the booklet ejecting opening 214 open to enable the passing of the booklet SA. The position shown by the single dot and dash line is the stop position to which the pusher 410 is moved horizontally by the driving means.

The movable holding members 421, which are arranged at the both end portions of the holder 420 arranged parallel to it in the neighborhood of the pusher 410, hold a two pairs of rollers 422 and 423 in such a way to enable their rotation. The two pairs of rollers 422 and 423 can move as rolling along the guide rails disposed at the both side end portions of the main body of the apparatus, to make the movable holding member 421 capable of moving up and down.

That is, the movable holding member 421 is driven to move up and down along the guide rails 424 by the motor M7 for moving the holder up and down and the driving means which are provided below the guide rails. The holder 420 as shown in the drawing shows that it has moved upward from the retracting position below and is in the state capable of holding the booklet SA.

Figure 11:
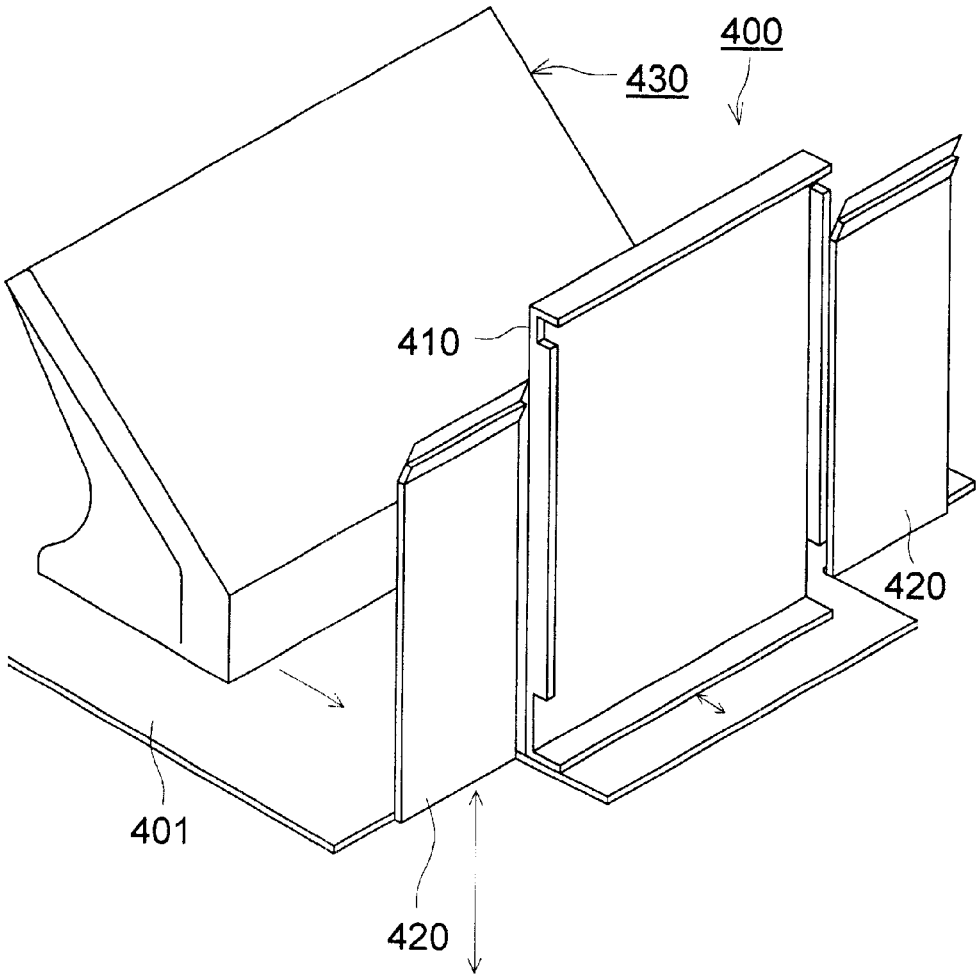
FIG. 11 is a perspective view of the movable wall member, partition member, and the pressing wall member.
Figure 12:
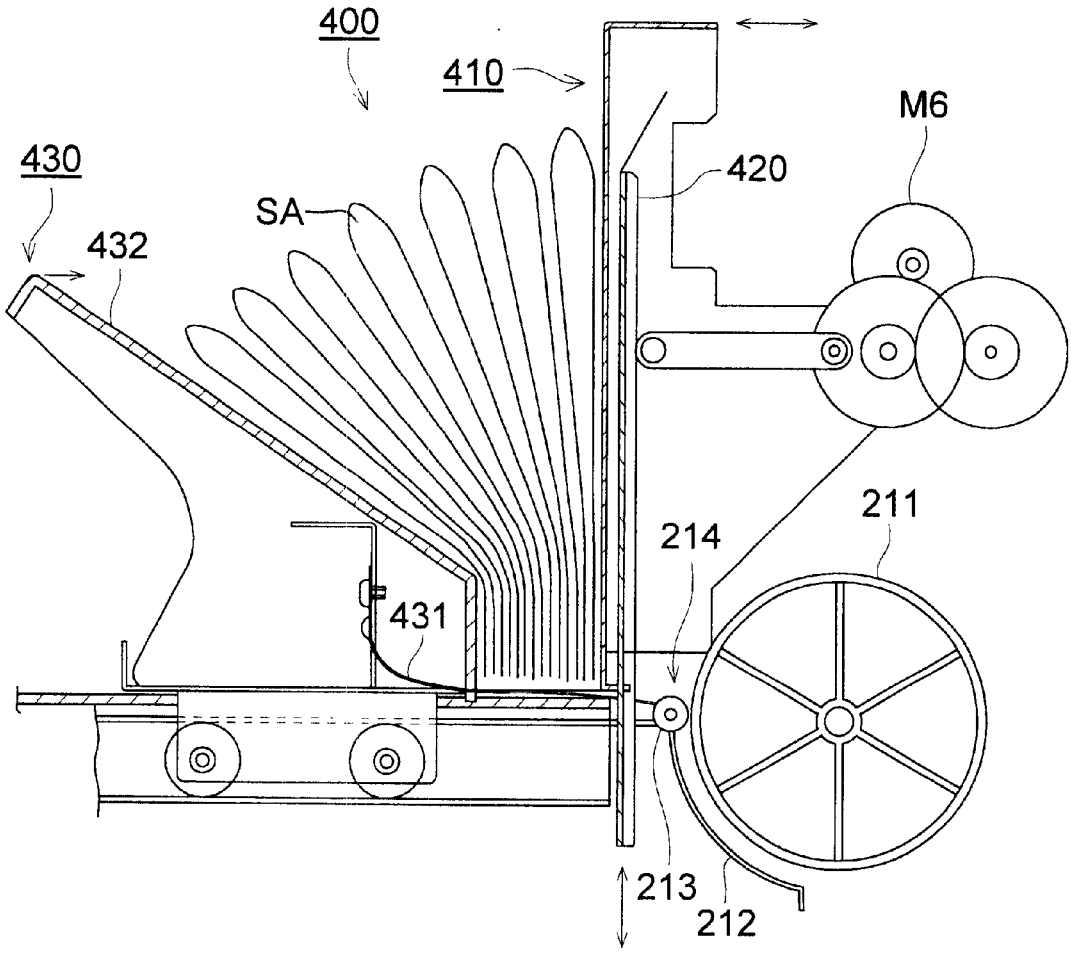
FIG. 12 is a cross-sectional view showing the booklet accommodating means in the state that a plurality of copies of a booklet are carried on the booklet carrying table.

FIG. 11 is a perspective view of the booklet accommodating means 400 composed of the pusher 410, the holder 420, and the pressing wall member 430. FIG. 12 is a cross-sectional view showing the booklet accommodating means 400 in the state carrying a plurality of copies of the booklet SA on the booklet carrying table 401.

The pusher 410 is moved in the horizontal direction shown by the arrow mark by the driving of the motor M6 for moving the pusher. The holder 420 is moved in the vertical direction shown by the arrow mark by the motor M7 for moving the holder up and down. The pressing wall member 430 is urged by the constant load spring member 431, and is moved in the horizontal direction shown by the arrow mark.

After the booklet SA is conveyed out from the booklet ejecting opening 214, and the lower edge portion of the booklet SA passes the gripping position of the large diameter roller 211 and the pinch roller 213, the pusher 410 starts to move forward by the driving of the motor M6 for moving the pusher. The pusher 410 moves forward and presses the booklet SA to move it to the direction of the holder 420. At approximately the same time as the start of the forward movement of the pusher 410, the holder 420 starts to descend by the start of driving of the motor M7 for moving the holder up and down. The lower part of the booklet SA is gripped closely in the upright position by the pusher 410 and the spring-urged pressing wall member 430. The upper parts of the booklets SA, each of which has the fold portion and makes a swollen shape, are supported as overlapping one another in the space extending over the tilted surface portion 432 of the pressing wall member 430. After the completion of the carrying of the booklets, or during the operation of carrying the booklets, it is possible to take out one of the booklets SA easily by holding the upper part of it.

Figure 13:
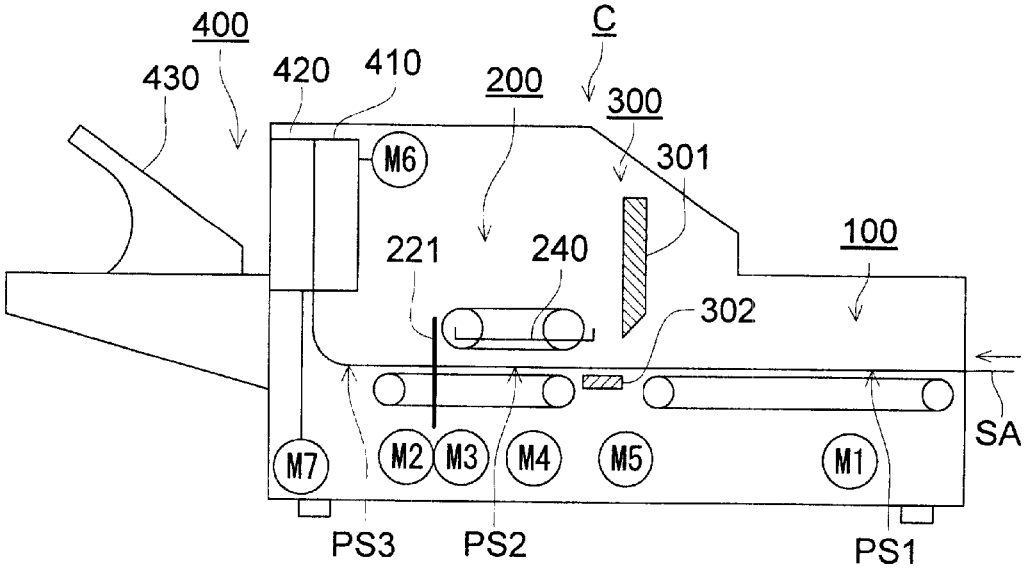
FIG. 13 is a schematic drawing showing the arrangement of the sensors and the motors in the paper sheet cutting apparatus.

FIG. 13 is a schematic drawing showing the arrangement of the sensors and the motors in the paper sheet cutting apparatus C. PS1 denotes the sensor placed at the entrance portion of the first conveyance means 100, PS2 denotes the conveyance portion sensor placed in the second conveyance means 200, and PS3 denotes the ejection portion sensor placed at the exit portion of the second conveyance means 200.

Figure 14:
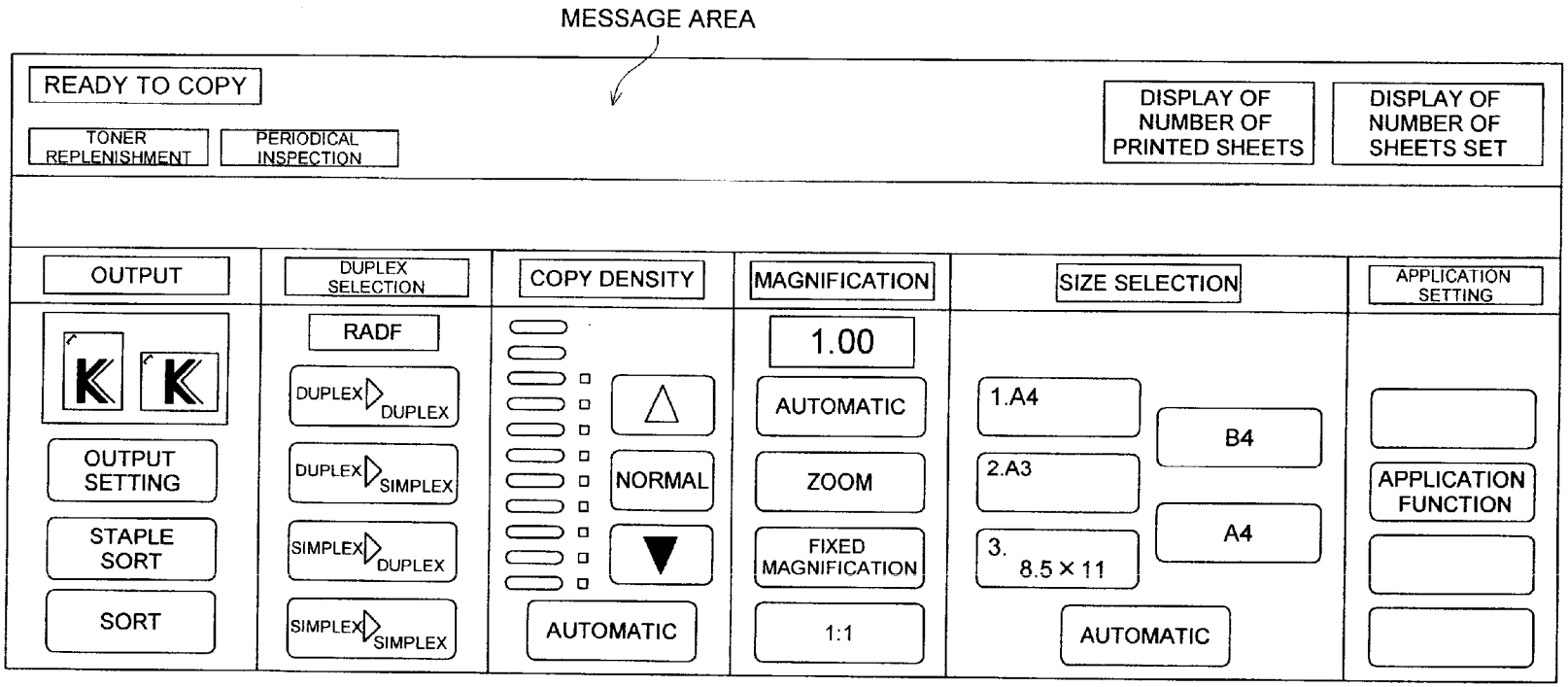
FIG. 14 is the plan showing the basic screen of the operation panel of the image forming apparatus mainframe.

FIG. 14 is the plan showing the basic screen of the operation panel of the image forming apparatus mainframe A. On this operation panel, if the paper sheet size, the number of sheets to set, etc. are set and further the output mode is set, the apparatus enters in the paper sheet after-processing mode shown in FIG. 15.

Figure 15:
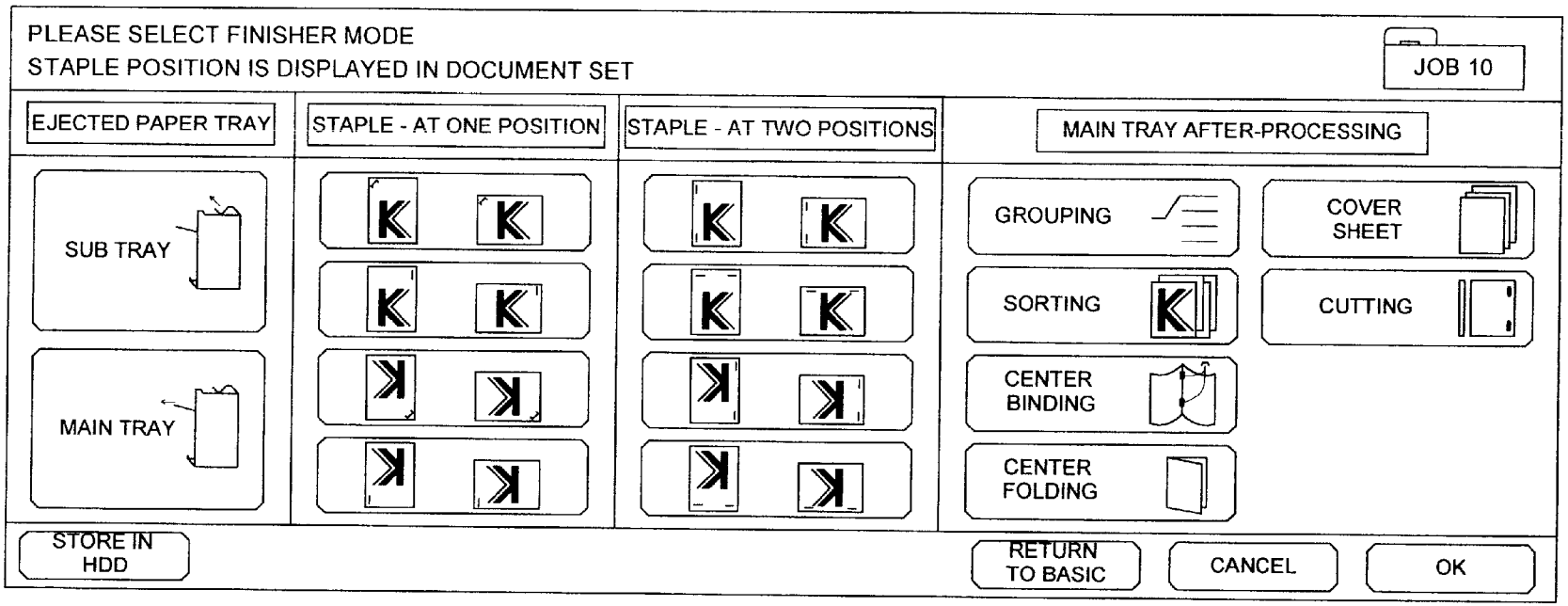
FIG. 15 is the plan showing the screen of the operation panel in the case where the paper sheet after-processing mode is set.
Figure 16:
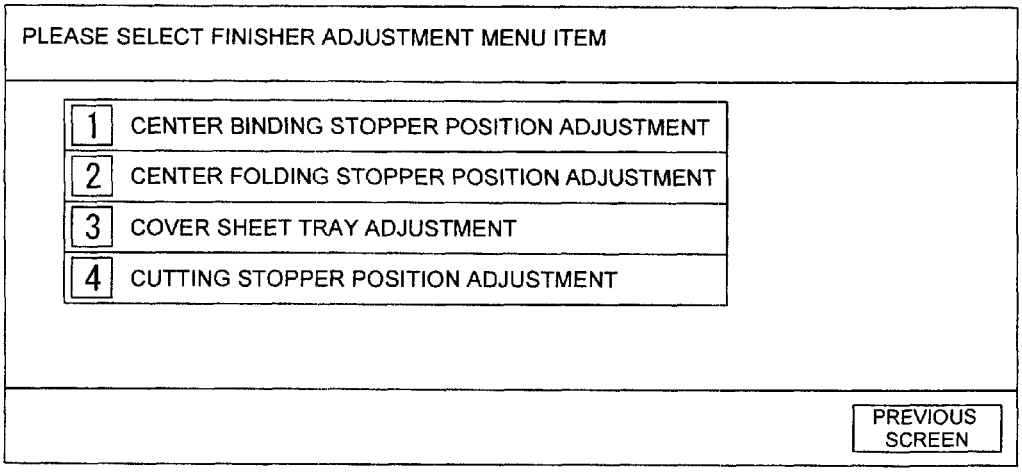
FIG. 16 is the plan of the operation panel showing the menu screen for adjusting the finisher.

FIG. 15 is the plan showing the screen of the operation panel in the case where paper sheet after-processing mode is set. In this screen, by selecting center binding, center folding, and cutting, and setting them by the OK key, the finisher adjustment menu screen appears as shown in FIG. 16. FIG. 16 is the plan of the operation panel showing the finisher adjustment menu screen.

Figure 17:
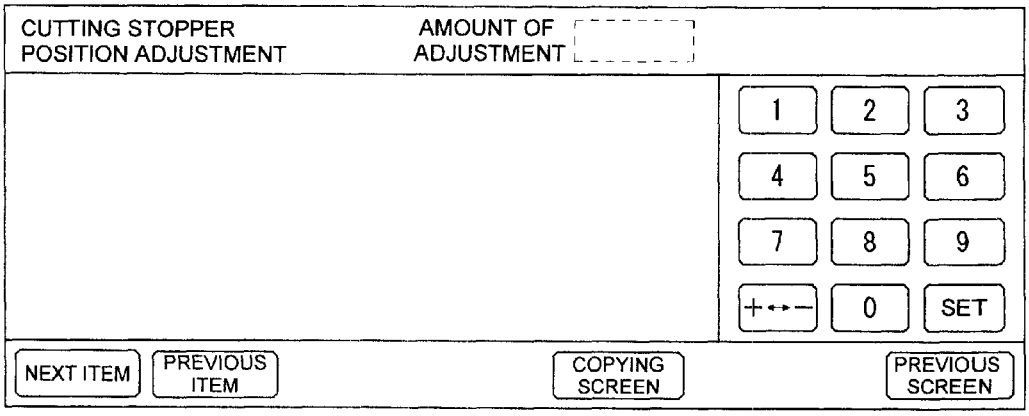
FIG. 17 is the plan of the operation panel showing the cutting stopper position adjusting screen.

If the cutting stopper position adjustment is set out of the center binding stopper position adjustment, the center folding stopper position adjustment, and the cutting stopper position adjustment, the cutting stopper position adjustment screen shown in FIG. 17 appears. FIG. 17 is the plan of the operation panel showing the cutting stopper position adjustment screen. In this screen, the amount of position adjustment is inputted by the numerical keys and it is settled by the setting key.

Figure 18:
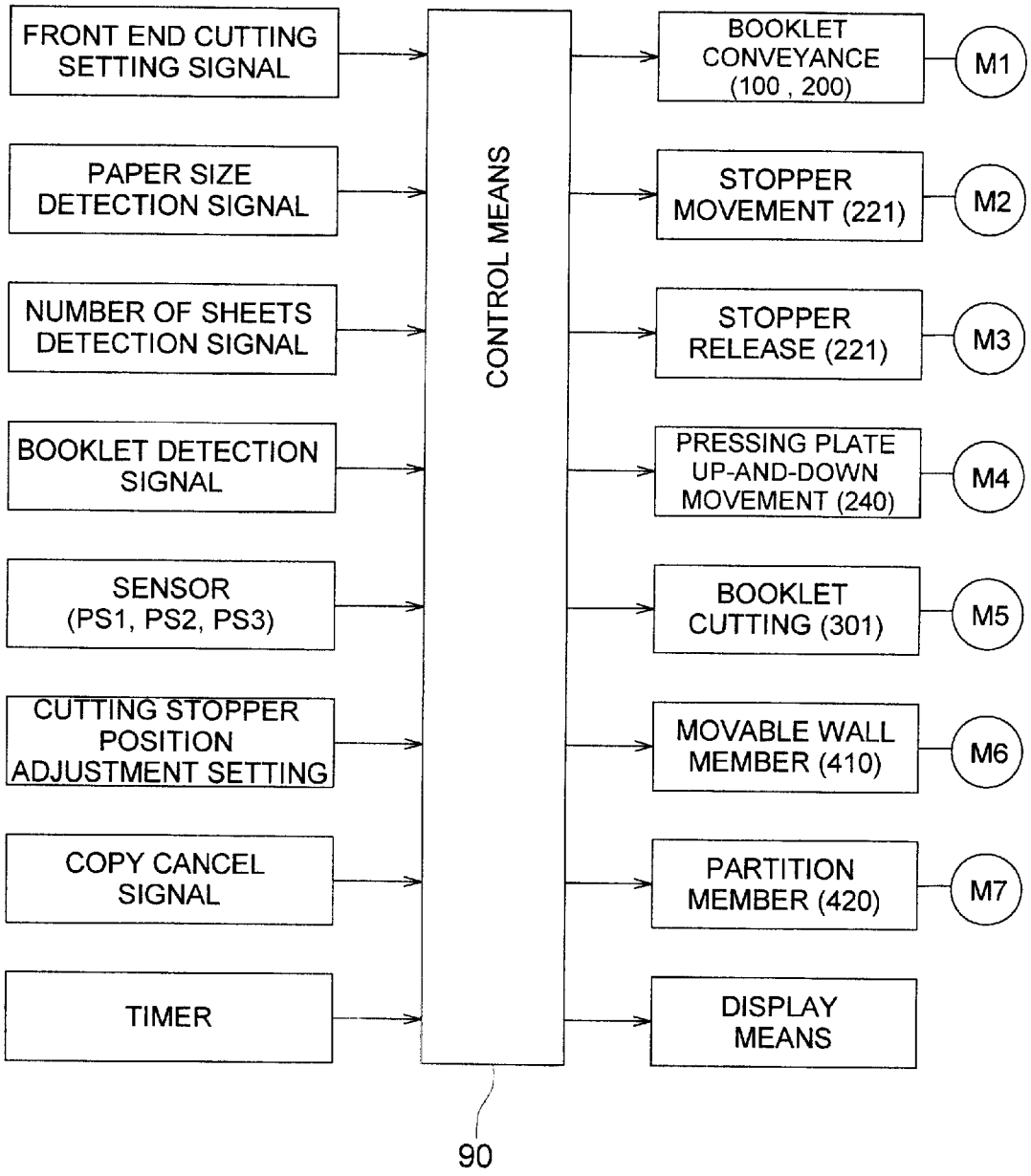
FIG. 18 is a block diagram showing the control of the paper sheet cutting apparatus.
Figure 19:
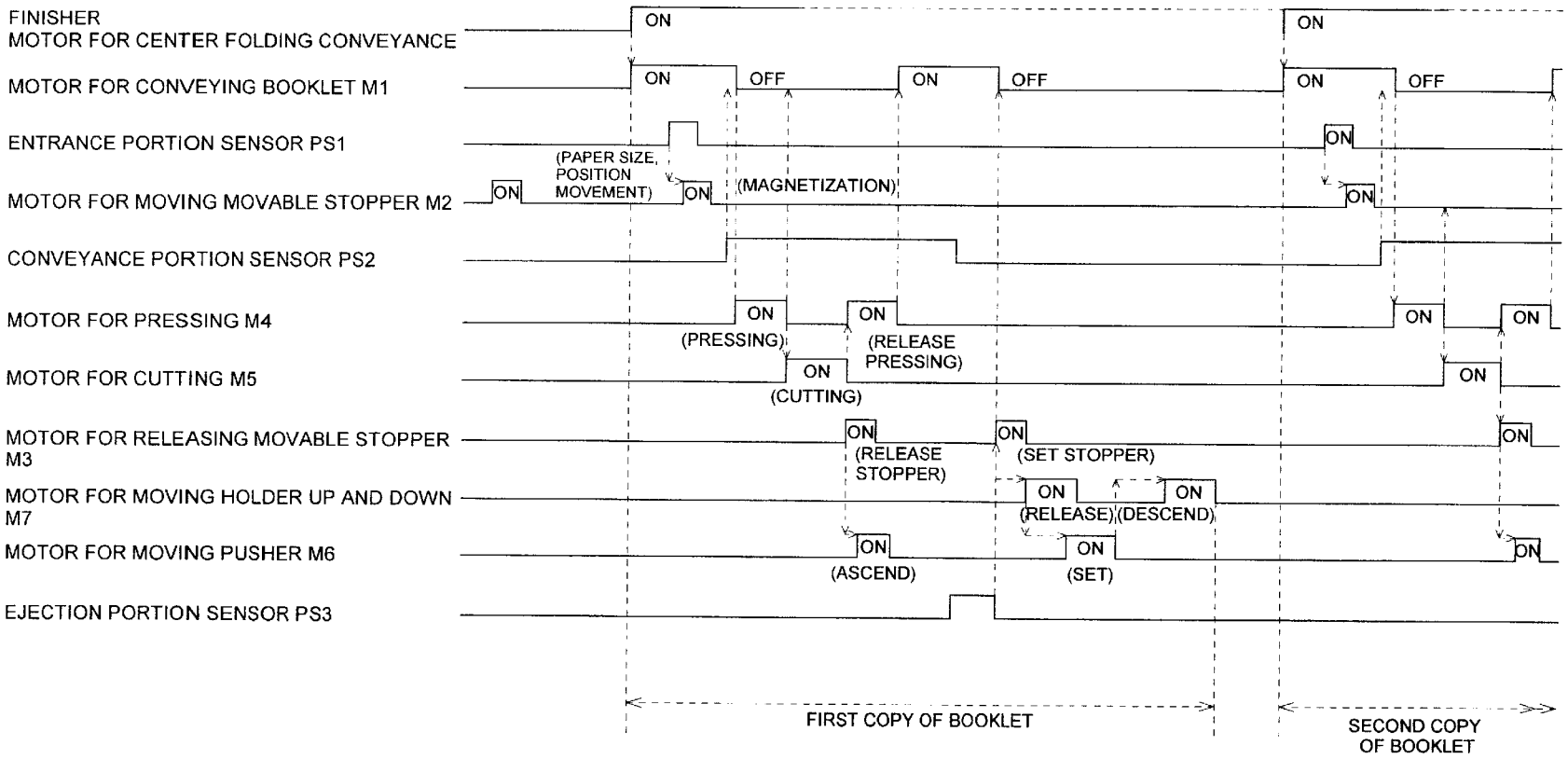
FIG. 19 is the time chart showing the control of the paper sheet cutting apparatus in the case of practicing the cutting processing.

FIG. 18 is a block diagram showing the control of the paper sheet cutting apparatus C, and FIG. 19 is the time chart in the case of practicing the cutting processing. In the following, the operation of each driving means by the control means 90 will be explained.

In FIG. 19, when the entrance portion sensor PS1 detects the passing of the leading edge portion of the booklet SA which is conveyed from the paper sheet after-processing apparatus B, after the passage of a specified time, the driving of the motor M2 for moving the movable stopper is started, and the movable stopper is moved to the position corresponding to the paper size, where it is stopped. When the conveyance portion sensor PS2 detects the passing of the leading edge portion of the booklet SA, the driving of the motor M1 for conveying a booklet is stopped. Linked to the stop of the motor M1 for conveying a booklet, the driving of the motor M4 for pressing is started. When the arrival of the pressing member 240 at the lower dead point by the motor M4 for pressing is detected, the driving of the motor M4 for pressing is stopped, and the driving of the motor M5 for cutting is started. After the driving of the motor M2 for moving the movable stopper is stopped, the motor M2 is kept in the magnetized state, and after the driving of the motor M5 for cutting is started, it is released from magnetization.

When it is detected that the upper cutting blade 301 is stopped at near the upper dead point by the stop of the driving of the motor M5 for cutting, the driving of the motor M4 for pressing, the motor M3 for releasing the movable stopper, and the motor M6 for moving the pusher is started.

When the arrival of the pressing member 240 at the upper dead point by the motor M4 for pressing is detected, the driving of the motor M4 for pressing is stopped, and the driving of the motor M1 for conveying a booklet is started, to convey the booklet SA to the paper ejection portion.

When the paper ejection portion sensor PS3 detects the passing of the trailing edge portion of the booklet SA, the driving of the motor M1 for conveying a booklet is stopped, while the driving of the motor M3 for releasing the movable stopper and the motor M7 for moving the holder up and down is started. After that, by the related operation of the motor M6 for moving the pusher and the motor M7 for moving the holder up and down, the booklet SA is accommodated in the booklet accommodating means 400.

(1) As shown in FIG. 19, the control means 90 practices a control such that, while the motor M5, which is the driving source of the cutting means 300, is driven, the driving sources of the means other than the cutting means 300, namely, the motor M1 for conveying a booklet, the motor M2 for moving the movable stopper, the motor M3 for releasing the movable stopper, the motor M4 for pressing, the motor M6 for moving the pusher, and the motor M7 for moving the holder up and down are made non-actuated.

(2) The control means 90 practices a control such that, by the setting of the number of sheets of the booklet SA (refer to FIG. 14) which is conveyed by the first conveyance means 100 and the second conveyance means 200, the motor M2 for moving the movable stopper is driven in order to make the stop position of the movable stopper 221 for the booklet SA variable.

(3) In the case where the number of sheets of the booklet SA is set at a value not more than a specified number (for example, 1 to 3 sheets), the control means 90 automatically cancels the processing, and displays that the cutting process is cancelled in the message area on the basic screen of the operation panel (refer to FIG. 14).

Figure 20:
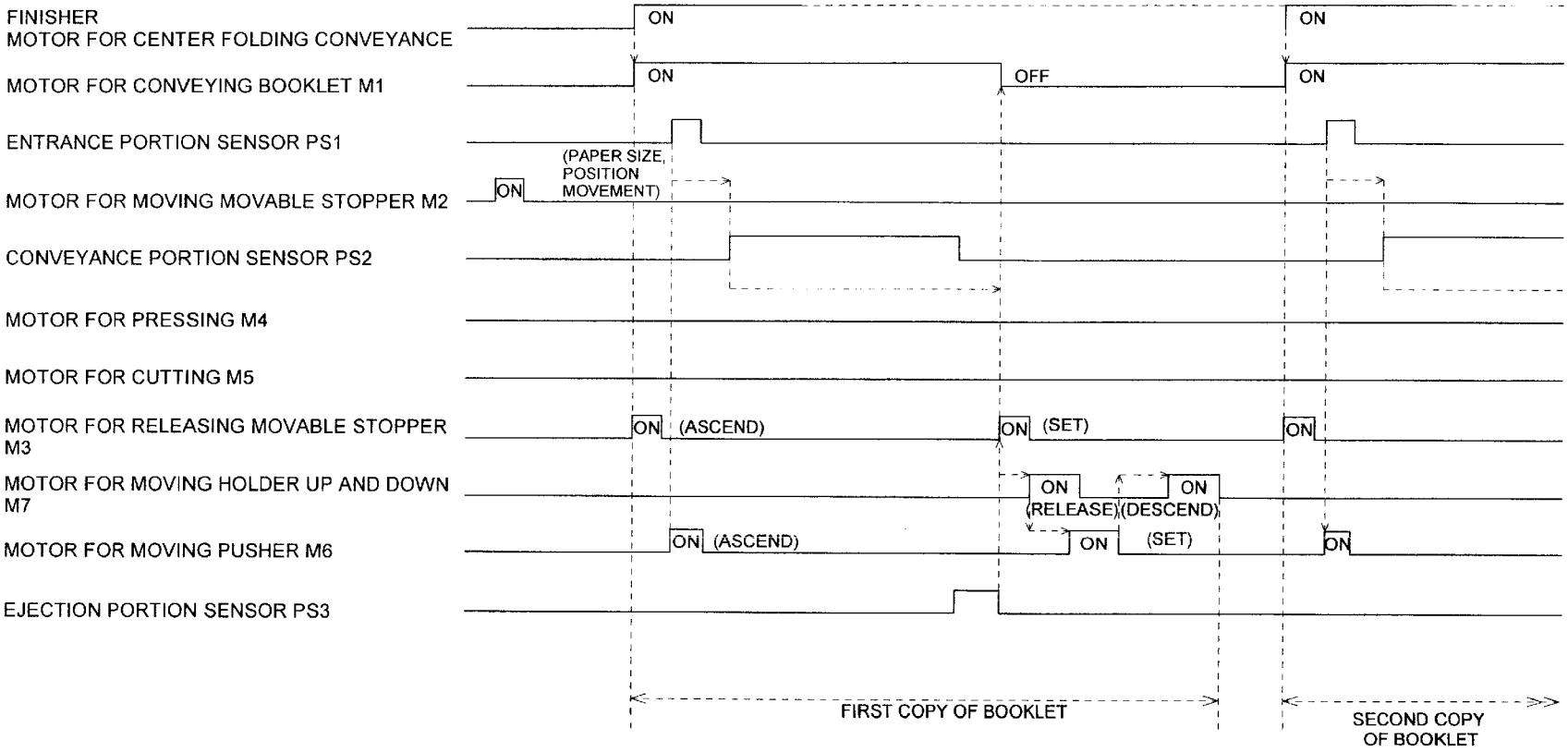
FIG. 20 is the time chart showing the control of the paper sheet cutting apparatus when no practice of cutting processing is selected.

(4) When the practice of cutting processing is selected, the control means 90 conveys the booklet SA after the cutting processing by the cutting means to the booklet accommodating means 400 by the first conveyance means 100 and the second conveyance means 200. When no practice of cutting processing is selected, the control means 90 practices a control such that the cutting processing by the cutting means 300 is not practiced, and the booklet SA is conveyed directly to the accommodating means 400 by the first conveyance means 100 and the second conveyance means 200. FIG. 20 is the time chart showing the control of the paper sheet cutting apparatus in the case where no practice of cutting processing is selected. When the apparatus is set in this mode, the motor M2 for moving the movable stopper, the motor M4 for pressing, and the motor M5 for cutting are kept in the non-actuated state, and the booklet SA, which has been introduced by the driving of the motor M1 for conveying a booklet, passes the cutting means 300, and is conveyed quickly to the booklet accommodating means 400.

(5) When the canceling operation is carried out during the image forming process (using the cancel button shown in FIG. 15), the control means 90 practices a control such that the cutting processing is not practiced and the booklet SA is conveyed to the booklet accommodating means 400 by the first conveyance means 100 and the second conveyance means 200. Owing to this, the booklet SA which is not to be cut-processed passes the cutting means 300 without stopping, and is conveyed quickly to the booklet accommodating means 400.

(6) The control means 90 practices the magnetization processing of the motor M2 for moving the movable stopper immediately before the leading edge portion of the booklet SA, which is conveyed by the first conveyance means 100 and the second conveyance means 200, hits the movable stopper 221, to keep the movable stopper 221 in the fixed state. Owing to this, it can be prevented that the movable stopper is moved by the shock produced when the leading edge portion of the booklet SA being conveyed hits the movable stopper 221.

Figure 21:
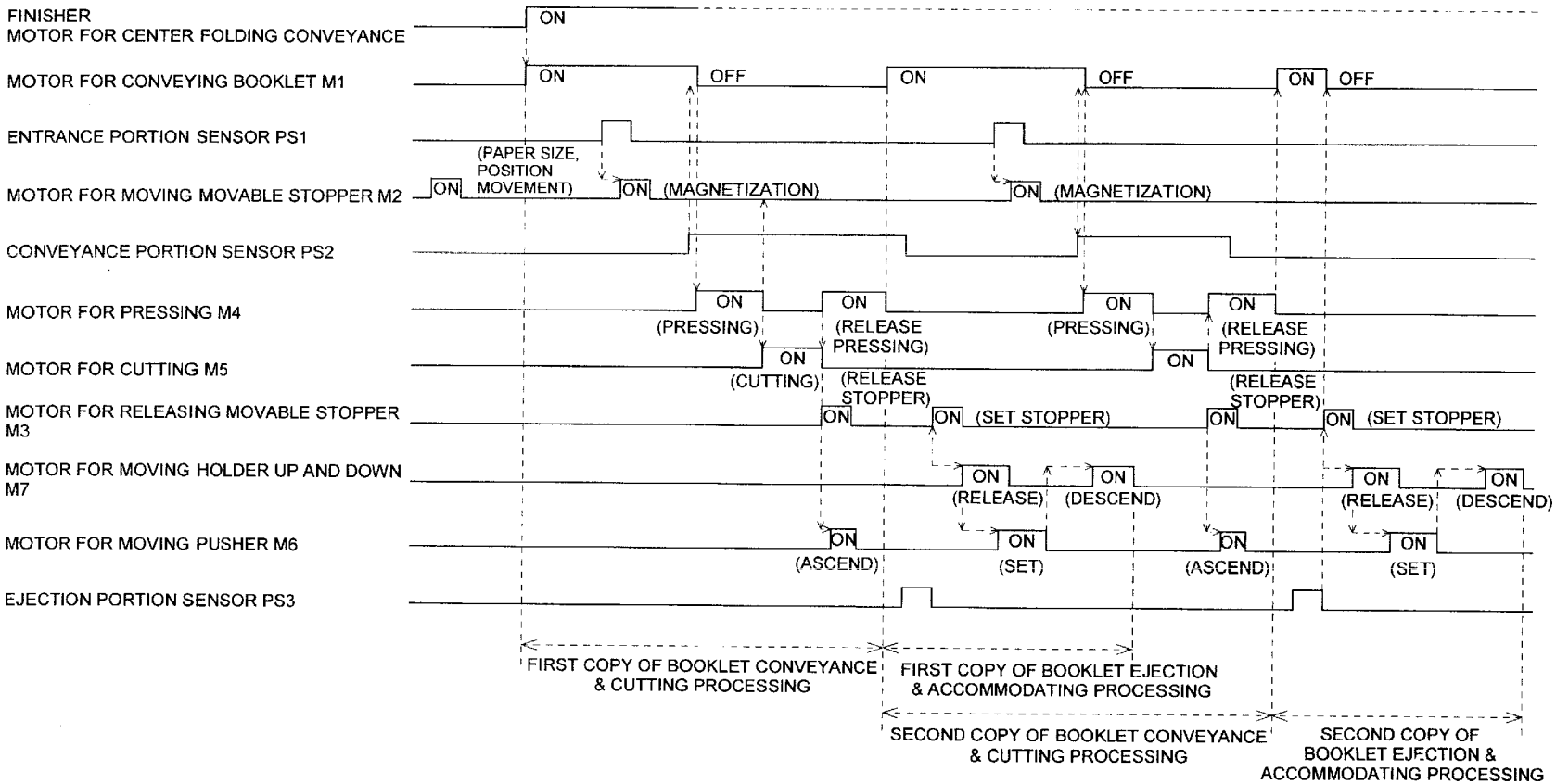
FIG. 21 is the time chart of the paper sheet cutting apparatus for controlling the conveyance of a preceding first copy of a booklet and the succeeding second copy of a booklet.

(7) FIG. 21 is the time chart of the paper sheet cutting apparatus C for controlling the conveyance of the preceding first copy of the booklet SA and the succeeding second copy of the booklet SA.

The control means 90 practices a control such that, while a copy of the booklet SA, which has been subjected to cutting processing by the cutting means 300, is conveyed to the booklet accommodating means 400 by the second conveyance means 200, the succeeding copy of the booklet SA is conveyed into the cutting means by the first conveyance means 100, and by doing this, the process of conveying out for a copy of the booklet SA after cutting processing and the process of feeding in for the succeeding copy of the booklet SA are carried out simultaneously.

That is, when the home position sensor (not shown in the drawing) detects that the pressing member 240 released from pressing action by the motor M4 for pressing and returns to the initial position, the control means 90 makes the driving of the motor M1 for conveying a booklet start, and makes the lower conveyance belt 201 of the second conveyance means 200 revolve, to eject a preceding copy of the booklet SA, which is accommodated in the booklet accommodating means 400. By the motor M1 for conveying a booklet, also the lower conveyance belt 111 of the first conveyance means 100 is made to revolve at the same time; the succeeding copy of the booklet SA, which has been introduced into the paper sheet cutting apparatus C, follows the preceding copy of the booklet SA with a predetermined interval kept in between, is conveyed into the cutting means 300, is conveyed by the second conveyance means 200, and is stopped at the stop position of the movable stopper 221. After that, the succeeding copy of the booklet SA is subjected to cutting processing, ejection processing, and accommodation processing.

By practicing the conveyance process with the trailing edge of a preceding copy of the booklet SA and the leading edge of the succeeding copy of the booklet SA made to come close, the productivity of the after-processing of the booklet SA is improved.

(8) The control means practices a control such that the stop position of the movable stopper is set in such a way that it is able to be adjusted corresponding to the amount of cutting which is arbitrarily set. In the finisher adjustment menu screen shown in FIG. 16, by setting the cutting position adjustment, a user obtains the cutting stopper position adjustment screen shown in FIG. 17. When an arbitrary amount of position adjustment is set through input by the numerical keys, the inputted amount of position adjustment is displayed in the upper part of the screen. By this function to set the amount of cutting arbitrarily, it becomes possible for the user to arbitrarily adjust the amount of cutting as he desires.

As described in the foregoing, according to a paper sheet cutting apparatus and a paper sheet after-processing apparatus of this invention, following effects can be obtained.

(1) A paper sheet cutting apparatus of this invention, when driving the driving source of the cutting means, controls the driving source of means other than the cutting means to be brought in the non-operational state; therefore, the position deviation of the movable stopper owing to the vibration of other driving means is prevented, which makes it possible to actualize the stabilization of the accuracy of the cutting position of the front end of a booklet.

(2) A paper sheet cutting apparatus of this invention controls the stop position of the stopper means to stop a booklet, which is conveyed to the cutting means by the conveyance means, to be variable depending on the number of sheets of the booklet; therefore, even if the difference in the amount of projection of the front end is produced depending on the number of sheets of the booklet SA (the thickness of the booklet), the cutting amount is always controlled to be an optimum value, and a booklet without excessive cutting or insufficient cutting is produced.

(3) In the case where the number of sheets of a booklet is set at a value not larger than a specified number, a paper sheet cutting apparatus of this invention automatically cancels the cutting processing, and displays on the screen of the operation portion that the cutting processing is not to be done; therefore, by displaying on the screen of the operation portion the poor performance that the cutting position is deviated in the case of a booklet having a small number of sheets, a user is made to take notice of it, and it can be prevented beforehand the poor cutting performance that possibly occurs in the case of the cutting processing for a booklet having a small number of sheets. Further, in the case where cutting processing is automatically cancelled, a user can be informed that the cutting processing is cancelled.

(4) A paper sheet cutting apparatus of this invention practices a control such that, in the case where the practice of cutting processing has been selected, it conveys a booklet after cutting processing by the cutting means to the booklet accommodating means by the conveyance means, and in the case where no practice of cutting processing has been selected, it conveys the booklet to the booklet accommodating means by said conveyance means without carrying out cutting processing by the cutting means; therefore, it can be arbitrarily selected a mode in which the apparatus accommodates a booklet in the booklet accommodating means without practicing cutting processing.

(5) In the case where canceling operation is carried out during the image forming process, a paper sheet cutting apparatus of this invention practices a control such that cutting processing by the cutting means is not carried out, and a booklet is conveyed to the booklet accommodating means; therefore, in the case where a trouble occurs in the image forming apparatus or in the paper sheet after-processing apparatus and copying is to be cancelled, the booklet in the paper sheet cutting apparatus can be quickly ejected, and the cancel processing time can be shortened.

(6) A paper sheet cutting apparatus of this invention keeps the movable stopper in the fixed state by applying magnetization processing to the motor for driving the movable stopper, immediately before the leading edge portion of a booklet which is conveyed by the conveyance means hits the movable stopper; therefore, it is reduced the collision induced deviation which is produced when the leading edge portion of a booklet hits the movable stopper, and it becomes possible to improve the accuracy of the cutting position of the front end of a booklet.

(7) A paper sheet cutting apparatus of this invention carries out simultaneously the conveyance processing of a booklet after cutting processing and the feed-in processing of the succeeding booklet, through feeding the succeeding booklet in the cutting means while the preceding booklet, which has been cut-processed by the cutting means, is being conveyed to the booklet accommodating means by the conveyance means; therefore, it is possible to improve the productivity of the after-processing owing to the shortening of cutting processing time.

(8) A paper sheet cutting apparatus of this invention sets the stop position of the stopper member of the stopping means to be capable of being adjusted corresponding to the amount of cutting which is arbitrarily set; therefore, it is possible for a user to arbitrarily adjust the stop position to a measure by which he desires to practice cutting.

(9) It is possible that paper sheets, on each of which an image is formed by an image forming apparatus of this invention such as a copying machine, a printer, and a compound machine of these, are subjected to center binding and center folding by a paper sheet after-processing apparatus, have the front end trued up uniformly by the cutting means of a paper sheet cutting apparatus, and are made a bound booklet, to be carried on the booklet accommodating means.

Disclosed embodiment can be varied by a skilled person without departing from the spirit and scope of the invention.

What is claimed is:

1. A sheet cutting apparatus for cutting a front end portion opposite to a folded portion of a booklet finished by a center folding processing, comprising:

a conveying device for conveying said booklet;

a stopping device for stopping said booklet at a predetermined position;

a cutting device for cutting said front end portion of said booklet;

a booklet accommodating device for accommodating said booklet processed by said cutting device; and a controlling section to control each of said conveying device, said stopping device, said cutting device and said booklet accommodating device;

wherein, when an execution of a cutting processing operation is selected, said controlling section controls said conveying device so as to convey said booklet processed by said cutting device to said booklet accommodating device, and, when a non-execution of said cutting processing operation is selected, said controlling section controls said conveying device so as to convey said booklet to said booklet accommodating device without performing said cutting processing operation.

2. An image-forming apparatus, comprising:

an image-forming section to form an image on a sheet, fed from a sheet feeding device, based on image information;

a sheet finishing section, which comprises a binding processor to apply a binding processing to a set of sheets, each of said sheets having said image formed by said image-forming section, and a folding processor to apply a folding processing to said set of sheets processed by said binding processor; and the sheet cutting apparatus defined by claim 1;

wherein said image-forming apparatus produces a booklet by applying said binding processing and said folding processing to said set of sheets, and said cutting device cuts said front end portion of said booklet.

* * * * *